US006786436B1

(12) United States Patent
van der Zanden

(10) Patent No.: US 6,786,436 B1
(45) Date of Patent: Sep. 7, 2004

(54) METHOD AND INSTALLATION FOR GUIDING MATERIAL IN A SINGLE ESSENTIALLY PREDETERMINED STREAM

(75) Inventor: Johannes Petrus Andreas Josephus van der Zanden, Ring of Kerry, Dunkilla, Tahilla, Co. Kerry (IE)

(73) Assignees: Rosemarie Johanna van der Zanden, Tahilla (IE); Johannes Petrus Andreas Josephus van der Zanden, Tahilla (IE); IHC Holland, N.V., Kinderdijk (NL)

( * ) Notice: Subject to any disclaimer, the term of this patent is extended or adjusted under 35 U.S.C. 154(b) by 0 days.

(21) Appl. No.: 09/959,919

(22) PCT Filed: May 11, 2000

(86) PCT No.: PCT/NL00/00317

§ 371 (c)(1),
(2), (4) Date: Mar. 22, 2002

(87) PCT Pub. No.: WO00/67909

PCT Pub. Date: Nov. 16, 2000

(51) Int. Cl.[7] ..... B02C 19/00
(52) U.S. Cl. ..... 241/5; 241/275
(58) Field of Search ..... 241/5, 275, 39, 241/40

(56) References Cited

U.S. PATENT DOCUMENTS 4,083,504 A * 4/1978 Wattles et al. ..... 241/275

FOREIGN PATENT DOCUMENTS

| | | |
|---|---|---|
| DE | 12 53 562 | 11/1967 |
| EP | 0 835 690 | 4/1998 |
| FR | 592 414 | 8/1925 |

* cited by examiner

*Primary Examiner*—Mark Rosenbaum
(74) *Attorney, Agent, or Firm*—Young & Thompson

(57) ABSTRACT

The invention relates to the field of the acceleration of material with the aid of centrifugal force, with the aim of causing the accelerated grains or particles to collide at such a speed that they break. According to a known technique, the material can be introduced into the central chamber of a rotor and accelerated along guide elements, after which the material is propelled outwards in all directions. The invention provides a method and installation which makes it possible to propel the material outwards from the rotor along one or more streams, the flow regions which the material describes being essentially in a predetermined, fixed location. This makes it possible to allow the material to impinge essentially free from interference on one or more stationary impact elements which are arranged around the rotor. It is also possible to distribute or to spread the material from the rotor in one or more predetermined directions.

25 Claims, 10 Drawing Sheets

III - III

IV - IV

METHOD AND INSTALLATION FOR GUIDING MATERIAL IN A SINGLE ESSENTIALLY PREDETERMINED STREAM

FIELD OF THE INVENTION

The invention relates to the field of the acceleration of material, in particular a stream of granular or particulate material, with the aid of centrifugal force, with, in particular, the aim of causing the accelerated grains or particles to collide at a speed such that they break.

According to a known technique the movement of a stream of material can be accelerated with the aid of centrifugal force. With this technique the material is introduced into the central chamber of a rotor and is then picked up by guide elements which are arranged around the central chamber and are supported by the rotor. Normally such a rotor rotates about a vertical axis of rotation; however, rotation can also take place about a horizontal axis. The material is accelerated along the guide elements and propelled outwards at high speed and at a certain angle of flight. The angle of flight is usually barely affected by the speed of rotation and is virtually constant for the individual grains in a granular stream. The speed which the material acquires during this operation is determined by the speed of rotation of the rotor. The speed of flight is composed of a radial speed component and a speed component oriented perpendicularly to the radial, or transverse speed component.

Viewed from the stationary standpoint and when the influence of air resistance and air movements are disregarded, the material moves at virtually constant speed along a virtually straight stream after it has left the guide element. This straight stream is directed forwards, viewed in the direction of rotation, and the magnitude of the angle of flight is in this case determined by the magnitudes of the radial and transverse speed components which, in turn, are determined by the length and positioning of the guide element and the coefficient of friction. If the radial and transverse components are identical, the angle of flight is 45°.

Viewed from a standpoint moving with the guide element, the material moves in a spiral stream after it leaves the guide element, which spiral stream is oriented backwards, viewed in the direction of rotation, and is in the extension of the guide element. In this case the relative speed increases as the material moves further away from the axis of rotation.

The material can be propelled outwards in this way, with the aim of distributing or spreading it regularly; for example salt on a road or seed over agricultural land.

The material can also be collected by a stationary impact element that is arranged in the straight stream which the material describes, with the aim of causing the material to break during impact. The stationary impact element can be formed, for example, by an armoured ring which is arranged around the rotor. The comminution process takes place during this single impact, the equipment being referred to as a single impact breaker.

Research has shown that for the comminution of material by means of impact stress a perpendicular impact is not optimum for the majority of materials and that, depending on the specific type of material, a higher probability of break can be achieved with an impact angle of approximately 75°, or at least between 70° and 85°. Furthermore, the probability of break can also be appreciably increased if the material to be broken is exposed not to single impact stress but to multiple, or at least double, impact stress in rapid succession. What is most important, however, is that the impact or impacts as far as possible take place free from interference.

Such a multiple impact can be achieved by, instead of allowing the material to impinge directly on a stationary impact element, first allowing the material to collide with an impact element that is moving with the guide element, that is rotating at the same speed, in the same direction and around the same axis of rotation, but at a greater radial distance from the axis of rotation than the guide element and is arranged transversely in the spiral stream which the material describes. Because the impact takes place essentially deterministically, the impact surface can be arranged at an angle such that the impact takes place at an optimum angle. The material is simultaneously stressed and additionally accelerated by the impact on the moving impact element before it impinges on the stationary collision element. With this arrangement both the acceleration and the impact take place in two steps, this equipment being referred to as a direct multiple impact breaker. With this arrangement it is possible then to allow the material to impinge on a further moving impact element which is arranged an even greater distance away from the axis of rotation.

It is thus possible to bring material into motion with the aid of centrifugal force and then to subject it to single or multiple stress in various ways.

BACKGROUND TO THE INVENTION

The invention described here relates to a rotor which rotates about an axis of rotation, by means of which material, in particular a stream of granular material, is accelerated with the aid of a guide element that is supported by the rotor, with the aim, in particular, of allowing the material to collide at such a speed that the material breaks. The rotor described here can be arranged in a comminution installation, for example a breaker or a mill, but can also be arranged in a distributor or spreader device.

In the known single impact breakers the impact surfaces of the stationary impact element are in general so arranged that the impact with the horizontal surface takes place perpendicularly as far as possible. The consequence of the specific arrangement of the impact surfaces necessary for this is that the armoured ring as a whole has a sort of knurled shape. Such an installation, which is equipped with a rotor which rotates about a vertical axis of rotation, is disclosed in U.S. Pat. No. 5,921,484.

PCT/NL 97/00 565, which has been drawn up in the name of the Applicant, discloses a method and installation for a direct multiple impact breaker which is equipped with a rotor which rotates about a vertical axis of rotation, by means of which the material is accelerated in two steps, these being, respectively, guiding over a relatively short guide element and impact by a moving impact element, in order then to be allowed to impinge on a stationary impact element in the form of individual evolvent impact elements which are arranged around the rotor. Stressing thus takes place in two immediately successive steps. The second impact takes place at a speed, or kinetic energy, which remains after the first impact, that is to say without additional energy having to be supplied. This residual speed is usually at least equal to the speed at which the first impact takes place. The stationary collision element can comprise an armoured ring or a bed of own material, whilst some of the material can be guided along the stationary collision elements bypassing the rotor.

U.S. Pat. No. 4,083,504 (Wattles et al.) discloses an apparatus with a rotor rotating about a vertical axis of rotation where the material is metered on the rotor with two upstanding chutes which are a distance away from the axis of rotation. This makes it possible to support the rotor with a shaft which is mounted on top of the rotor between the chutes; which results in a rotor which is hanging free above the hopper. As a whole this results in a more compact construction and makes the axis and drive and rotor more easily accessible. A problem is that the material has to be fed to the rotor a distance away from the axis of rotation because the shaft is in the middle. To obtain a reasonable regular distribution of the material to the rotor, in such a way that the material is spread all around the rotor to be accelerated and to impact against the circular series of depending fixed impactors that are positioned around the rotor, the material is fed to the rotor through at least two chutes which are mounted opposite of each other, and the bottom of these chutes are preferably directed angled towards the axis of rotation and attached to a coverbox having two holes for the chutes to meter the material to the centre of the rotor and a hole for the axis.

SUMMARY OF THE INVENTION

The known rotors have the advantage that when the material is picked up by the guide elements it is effectively accelerated and propelled outwards in a targeted manner, it being possible accurately to adjust the speed with the aid of the speed of revolution. Furthermore, the construction is simple and both small and relatively large quantities of granular material having dimensions which range from less than 1 mm to more than 100 mm can be accelerated. The known impact breakers also have a number of advantages. For instance, the breakers are simple and consequently not expensive to purchase. The direct multiple impact breaker in particular has a high comminution intensity. The known direct multiple impact breaker has a comminution intensity at least twice as high as that of the known single impact breaker, incidentally for the same energy consumption. In addition to these advantages, the known rotors and breakers are also found to have disadvantages. For example, as a result of the centric nature of the known rotors the material is propelled outwards in all directions around the rotor, which constitutes a problem if it is desired to direct the material in a specific direction away from the rotor. In the case of comminution installations the material stream collides with a stationary armoured ring and the edges of the projecting corners of the armoured elements partially interfere with the impacts. These interfering influences are fairly large, although very much lower in the direct multiple impact breaker than in the single impact breaker. In the direct multiple impact breaker the first collision takes place undisturbed against the moving impact element, without the material leaving the rotary environment. In the case of projecting corners of armoured elements in a single impact breaker the interference effect can be indicated as the length which is calculated by multiplying the diameter of the material to be broken by the number of projecting corner points on the armoured ring relative to the total length or the circumference of the armoured ring. In the known single impact breakers often more than half the grains in the material stream are subject to an interference effect during impact. This interference effect increases substantially as the projecting corners become rounded under the influence of wear.

These interference effects have a substantial influence on the probability of break, which declines sharply as the interference effect increases. Therefore, the collision speed usually has to be increased in order to achieve a reasonable degree of comminution, which demands additional energy and causes wear, and thus the interference effect, to increase even more substantially, whilst an undesirably high number of very fine particles can be produced. The consequence of these various aspects is that the comminution process is not always equally well controllable, as a result of which not all particles are broken in a uniform manner. As a result the broken product obtained frequently has a fairly wide spread in grain size and grain configuration.

The centric nature constitutes another disadvantage of the known impact breaker. After all, the material is metered in a stream into the central chamber of the rotor and from there is uniformly distributed around the rotor blade and accelerated in order then to be propelled outwards in all directions from the edge of the rotor blade like a fan onto a stationary impact element. The material drops down after this collision and, as it were, forms an all-round cylindrical curtain, which is collected beneath the rotor in a funnel with the outlet in a region centrically below the rotor. Therefore, the space above, around the outside of and beneath the rotor must as far as possible be kept free so that the granular traffic is not impeded. If the shaft of the rotor is continued upwards this hinders metering. The shaft can therefore only be mounted on bearings below the rotor, which yields a less stable construction. A second bearing above the rotor would yield a much simpler and more stable construction. If the shaft is continued downwards this impedes the discharge. The shaft therefore has to be supported on the side walls of the breaker, which demands a fairly heavyweight construction which has to be mounted in the breaking chamber. The funnel construction which, because of its large diameter, has to be made relatively high, therefore has to be arranged further towards the bottom, which requires even more height in the overall construction. Finally, the shaft must be driven by a motor which has to be set up in its entirety outside the breaking chamber, which demands relatively long V-belts which have to be fed in a tubular construction through the breaking chamber. Direct drive is essentially not feasible. All of this means that the construction cannot be optimised and has to be made fairly heavy and high, whilst the passage of the material is also impeded by the various auxiliary constructions.

AIM OF THE INVENTION

The aim of the invention is therefore to provide a method and an installation, as described above, having a rotor which does not have these disadvantages or at least displays these disadvantages to a lesser extent. The aim is achieved by propelling the material, after it has been metered onto the rotor, distributed and accelerated, not outwards in all directions around the rotor but in at least one separate flow region which is located at a fixed—that is immobile—location, viewed from a stationary standpoint, which is not influenced by the speed of rotation, after which the material is either struck once with the aid of at least one stationary impact element that is arranged in the flow region, or collides twice in immediate succession in the flow region with the aid of at least one moving collision element which is associated with the guide element and at least one stationary collision element, which collision elements are both arranged in the flow region, and is further described in the claims, to which reference is made.

The method and installation of the invention make use of the fact that the movement of the material, from the point in time when the material is picked up from the central chamber of the rotor by the guide element and is then accelerated and propelled centrifugally outwards, follows an entirely deterministic path (as is described in detail in PCT/NL 97/00656), in other words:

that the location where the material is picked up from the central chamber by the guide element determines the flow region in which the material moves further;

that the material stream which is fed continuously to the guide element continues to move in the flow region;

that the direction of movement of the material in the flow region is not influenced by the speed of rotation of the rotor.

This makes it possible to accelerate the granular material and then to guide it into one flow region which is located at a fixed—that is immobile—location which is not rotating with the rotor and is not influenced by the speed of rotation and to cause the material to undergo a single collision or multiple collisions in the flow region.

With the method according to the invention the rotor carries at least one guide element that is provided with a guide surface having a start edge and an end edge, which guide element extends in the direction of the outer edge of the rotor. When the rotor rotates the start edge, which is located a radial distance away from the axis of rotation, forms an imaginary revolving body, within which the start edge revolves and the axis of revolution of which is coincident with the axis of rotation of the rotor, and this so-called first revolving body as it were determines the central chamber of the rotor. If the start edge is oriented perpendicularly to the rotor or the plane of rotation, the central chamber is of cylindrical shape. If the start edge is oriented at an angle, the shape is conical. The material is metered into at least one metering region with the aid of a stationary metering element that is provided with at least one metering port, which metering region is determined on the rotor in a fixed location, viewed from a stationary standpoint, on a position in a sector of the first revolving body, which sector is determined by the space between two radial surfaces from the axis of rotation and the two parallel circles which delimit the first revolving body. The stationary metering element can comprise a type of funnel, tube or channel construction which is provided with one or more outlets which act as metering ports. Once in the sector, the material moves outwards in virtually the radial direction. Specifically, the surface of the central chamber is revolving so rapidly that the grains essentially do not sense it or barely sense it. (This behaviour can be compared with pulling a tablecloth very quickly from a table laid with crockery; if this is done quickly enough the crockery remains in place). During this movement the grains therefore move from the metering region, which is located a smaller radial distance away from the axis of rotation than is the edge of the central chamber (first imaginary revolving surface), in the radial direction towards a feed region which is located a greater distance away from the axis of rotation than is the edge of the central chamber. During this movement the grains therefore have to pass the outer edge of the central chamber, or the first revolving surface. In essence there can be said to be a first imaginary window in the revolving surface, the periphery of which is determined by the section (arc) of the first revolving surface that describes the sector. In the feed region, which is located close to but just beyond the first window, the material is picked up by the guide element when the latter passes through the feed region. The location where the material passes through the first window now determines the further direction of movement, or flow region, along which the material moves when it is accelerated along the guide surface, leaves the guide element at the end edge and then is propelled outwards through a second window in a second revolving surface that is formed by the revolving body in which the end edge is revolving. The first section of the flow region in which the material is accelerated along the guide surface is oriented forwards, is spiral in shape, and extends from the first window towards the second imaginary window, by means of which the location is determined. The second section of the flow region, in which the grains move when they leave the guide element, is straight and oriented forwards. The location is determined by the angle of flight at which the material leaves the guide element. There is thus a flow region which is located in a fixed location. The second section of the flow region can, incidentally, also be regarded from a standpoint moving with the guide element, in which case the flow region is spiral in shape and oriented backwards.

The feed of material to the guide element takes place only at the location of the edge of the sector, or through the first window, and is therefore continually interrupted. Material is picked up only at the point in time when the guide element crosses the stream along which the material is directed outwards, or the feed region, the next portion is picked up by a following guide element at the point in time when the latter crosses the feed region, etc. A specific stream of material which is fed through the first window to the feed region is thus distributed over various guide elements and successive portions from the respective streams which cross the guide element then move along a specific guide element. It is possible to equip the rotor with a single guide element; the material is then picked up in successive portions during each revolution.

Thus, the stream of material moving outwards along the guide element is not a continuous stream but a discontinuous stream which consists of successive portions of the stream of material, or material portions, with free spaces between them. The magnitude of the free spaces is determined by the number and the width, around the periphery, of the first revolving body. As a result of the acceleration both the length of the material portions and of the free space increase along the guide surface as the material becomes further removed from the axis of rotation. At the location of the end edge the material leaves the guide element and the material portions are propelled successively outwards along a flow region. As a whole one or more flow regions which widen towards the outside and in which the respective material portions move outwards as individual particle streams are produced in the breaking chamber, which regions are interrupted by empty space all round. Each of these streams can be collected by an impact element mounted such that it is stationary, which impact element is arranged in an impact location with the impact surface directed transversely to the direction of movement described by the material in the straight flow region concerned, viewed from a stationary standpoint; however, the material can also first be accelerated by a moving collision element associated with the guide element, which collision element is arranged in a collision location with the collision surface directed transversely to the direction of movement of the material in the spiral flow region, viewed from a standpoint moving with the guide element, after which the material is further guided, when it leaves the moving collision element, into a third straight section of the flow region, in the direction of a stationary collision element that is arranged in a collision location with the collision surface oriented transversely to the direction of movement of the material in the third flow region.

Thus, viewed from a stationary standpoint, the location where the material is picked up by the guide element determines the location at which the material leaves the guide element and the location where the material collides with the stationary collision element and optionally, in between these, the location where the material collides with one (or more) moving collision elements.

As has been stated, the sector in which the material is metered into the central chamber describes a first mid-point angle. The flow region widens as the material becomes further removed from the axis of rotation. The paths described by the material portions which are picked up by the guide element each time the latter passes through the flow region are always located in the flow region in a position between two radial planes from the axis of rotation which describe a mid-point angle which is approximately equal in size to but not smaller than the first mid-point angle. The impacts between the moving and stationary collision elements therefore also always take place between two radial planes from the axis of rotation which describe a mid-point angle which is no greater than the first mid-point angle.

The method of the invention makes an installation possible which has a rotor which rotates about an axis of rotation which can have been arranged either vertically or horizontally, whilst the rotor essentially is also able to rotate about an axis of rotation arranged at an angle.

Equipped with a vertical shaft, a type of eccentric cross-flow breaker is produced as a whole. After all, there is material which is metered at a metering location eccentrically from the axis of rotation and then moves outwards as particles along a stream transversely through the breaker, which particles then collide with one stationary collision element that is arranged eccentrically at a location outside the rotor. The abovementioned centric nature of the impact breaker is thus dispensed with, which makes the construction and the feed and discharge of material much simpler.

The disadvantage of such an eccentric construction is the capacity, which is restricted because the material has to be guided outwards from the distributor element through one window in a single stream. The capacity of the window can be appreciably increased by allowing the distributor element to vibrate or jolt or otherwise to move, in its entirety or at the location of the port, so that the throughput is promoted. The method of the invention also provides the facility for metering the material at high speed and in a more targeted manner at the metering location, so that the material is guided into the desired stream at high speed and more material, or larger portions of the stream of material, are picked up by the guide element at the point in time when this crosses the stream of material. This is achieved by guiding the material outwards from the conveyor belt with the aid of a distributor element in the form of a sloping channel construction, optionally a vibrating channel, which is directed onto the distribution location and, if possible, also arranging the conveyor belt in the extension of this stream.

The invention provides the facility for continuing the shaft upwards and providing it with additional bearings without feeding and metering being impeded, whilst the shaft can be supported directly on a foundation construction below the rotor, without the discharge being impeded, the material stream being collected, after it has collided with the stationary collision element, at a location beyond the rotor and discharged. A small funnel can suffice for this purpose, whilst the conveyor belt, by means of which the material is discharged, does not have to be continued to below the rotor. This makes it possible to make such an eccentric impact breaker of relatively simple, less high and compact construction, with a relatively lightweight shaft construction, with lighter-weight bearings, without heavy support constructions and without a large funnel construction. This makes the breaker outstandingly suitable for a mobile set-up.

The invention also provides a facility for supporting the shaft construction on a support construction that is housed in a support sector of the circular chamber around the axis of rotation. This support sector normally describes a mid-point angle which is no greater than 90° to 180°, but it is also possible to restrict this to 30°. In essence, the support construction (sector) can be continued to the edge of the rotor. What is achieved by this means is that after the material has impinged on the stationary impact element it is able to drop down freely in the region beyond this support sector and is not impeded by support and drive constructions. Only the material that impinges on the stationary impact element in a region above the support sector has to be guided downwards over this sector. This method of construction has the advantage that the shaft construction can be supported easily because the space beneath this support sector can be fully extended towards the bottom and provided with foundations. The easy accessibility of such an open support sector also makes it possible to provide the shaft with a direct drive in this space.

Equipped with a horizontal shaft, this shaft can be supported and provided with bearings on one side or on both sides of the rotor. Here the first window through which the material is guided from the central chamber to the guide element is usually determined, under the influence of gravity, in the lower half of the central chamber. With this arrangement it is preferable, but this is not essential, to construct the central chamber in the form of a type of stationary, approximately half-open drum, the bottom open section of which acts as the window. The material is guided through this window to the guide elements. In other respects the mode of operation is essentially the same as that for an installation constructed with a vertical shaft.

The invention provides a facility for guiding the material outwards from the central chamber into more than one flow region. This is achieved, for example, by constructing the metering element with multiple metering ports by means of which the material is metered into several sectors in the central chamber. It is also possible to distribute the material with the aid of a stationary distributor element from the central chamber over multiple feed regions. Such a distributor element consists of a number of stationary deflector elements which are arranged in a position along the central chamber. The material is directed outwards from the central chamber in a number of streams between these stationary deflector elements—or, as it were, through ports. The stationary deflector elements can be constructed in the form of circular or triangular rods; in each case such that no material can adhere thereto under the influence of midpoint centrifugal force and at least not such that the passage of the material is impeded by this centrifugal force. If the central chamber is arranged such that it is stationary, the deflector elements can be supported by the metering surface. The deflector elements can prevent the passage of the material, or grain traffic, through the ports. Because these have been arranged such that they are stationary, the deflector elements, but also the entire distributor element, can be brought into vibration, or into a jolting state, in a relatively simple manner, by which means the throughput of material is promoted. Once it has been guided outwards through the port, the stream of material is picked up in portions by one or more rotary guide elements at the feed locations, which are located in a position just outside the ports.

The method of the invention thus makes it possible to guide the stream of material, with the aid of a distributor element, outwards from the metering region of the rotor to positions such that the streams of particles do not strike the projecting corners and edges of the moving impact elements and stationary collision elements: these are, as it were, "masked" with the aid of the deflector elements. The interfering effect which can be caused by these projecting corners and edges is consequently virtually eliminated. The method of the invention thus makes it possible so to synchronise the movement of the material and the impact element that the material is successively stressed several times in an (essentially deterministic) manner, free from interference, it being possible accurately to control the speed at which the successive collisions take place with the aid of the angular speed.

What is achieved in this way is that the probability of break is appreciably increased, the energy consumption is reduced, as is the wear, and a break product of uniform quality is produced.

BRIEF DESCRIPTION OF THE DRAWINGS

For better understanding, the aims, characteristics and advantages of the invention which have been discussed, and other aims, characteristics and advantages of the invention, are explained in the following detailed description of the invention in relation to accompanying diagrammatic drawings.

BEST WAY OF IMPLEMENTING THE METHOD AND INSTALLATION OF THE INVENTION

A detailed reference to the preferred embodiments of the invention follows below. Examples thereof are shown in the appended drawings. Although the invention will be described together with the preferred embodiments, it must be clear that the embodiments described are not intended to restrict the invention to these specific embodiments. On the contrary, the intention of the invention is to comprise alternatives, modifications and equivalents which fit within the nature and scope of the invention, as defined by the appended claims.

Figure 1:
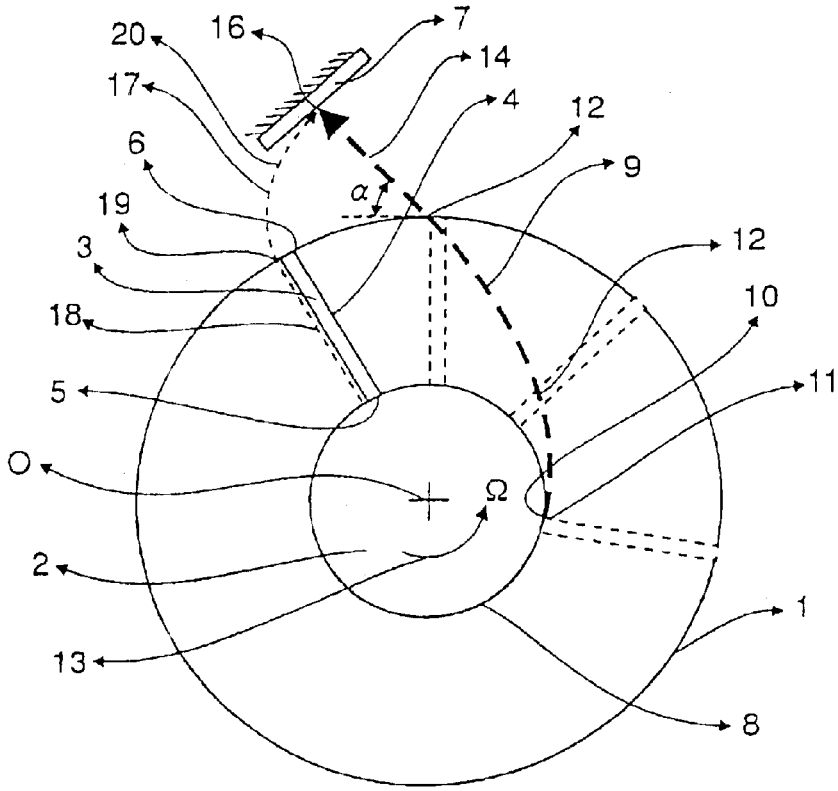
FIG. 1 shows, diagrammatically, the path which a grain describes on a rotor equipped with a guide element that is carried by the rotor and a stationary impact element.

FIG. 1 shows a rotor (1) having a central chamber (2) and a guide element (3) that is carried by the rotor (1). The guide element (3) is equipped with a guide surface (4) and a revolving start edge (5) and an end edge (6). The central chamber (2) is essentially formed by the revolving body that is defined by the revolving start edge (5). The rotor (1) is rotatable about an axis of rotation (0). A stationary collision element (7) is arranged in a location outside the rotor (1). A grain from the stream of material is metered into the central chamber (2) and is then picked up from the edge (8) of the central chamber (2) by the guide element (3). The grain moves under the influence of mid-point gravitational force along the guide surface (4) towards the end edge (6). The movement of the grain is accelerated during this movement. At the location of the end edge (6) the grain leaves the guide element (3) and is propelled outwards at an (essentially constant) angle of flight ($\alpha$), after which it impinges on the stationary collision element (7).

Viewed from a stationary standpoint, during the movement along the guide surface (4), or between the position (11) where the grain is picked up by the guide element (3) and the position (12) where the grain leaves the guide element (3), the grain describes a spiral portion (15) of the path (9), which is oriented obliquely forwards, viewed in the direction of rotation (13); from the release position (12) the grain is brought into a straight portion (14) of the path (9), which straight portion is oriented obliquely forwards, viewed in the direction of rotation (13). The direction of the straight portion (14) is determined by the first angle of flight ($\alpha$). This first angle of flight ($\alpha$) is not determined (influenced) by the speed of rotation. In this context it can be pointed out that the path (9) which the grain describes is essentially not influenced by the angular speed at which the rotor (1) rotates. The spiral portion (15) and the straight portion (14) of the path (9) which the grain describes between the position (11) where it is picked up by the guide element (3) and the position (16) where the grain strikes the stationary collision element (7) are predetermined as a whole and it can be stated that the path (9) is in a fixed—that is immobile—location, viewed from a stationary standpoint.

Viewed from a standpoint moving with the guide element, the grain describes a path (17) as a whole, the first portion

(18) of which path (17) along the guide element (3) describes a path (19) directed forwards which is directed along the guide surface (4) and the second portion of which path (17) describes a spiral path (20) which is directed backwards, viewed in the direction of rotation (13).

Figure 2:
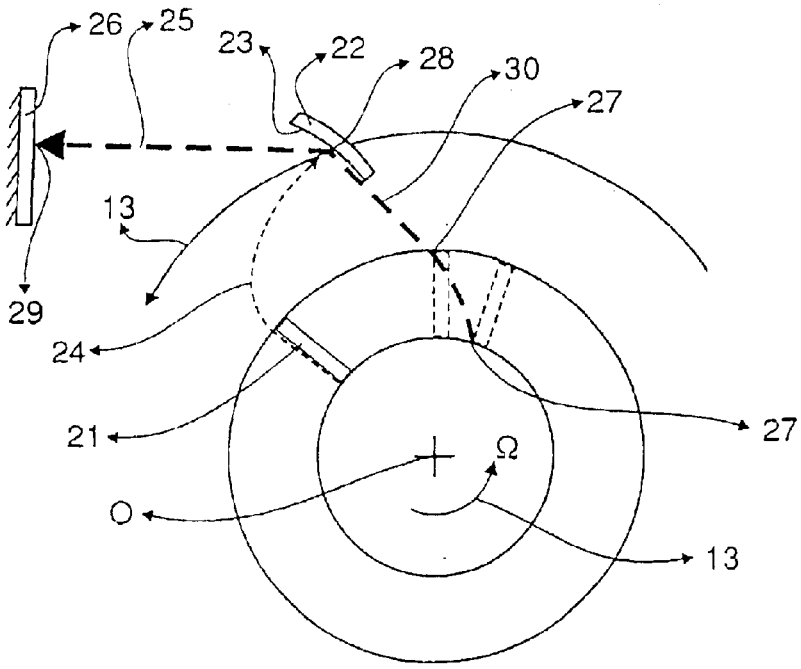
FIG. 2 shows, diagrammatically, the path which a grain describes on a rotor equipped with a guide element and a moving collision element which are carried by the rotor and a stationary collision element.

FIG. 2 shows a situation similar to that in FIG. 1, where, however, after it leaves the guide element (21) a grain from the stream of material is first struck by a moving collision element (22). The moving collision surface (23) of the moving collision element (22) is arranged essentially transversely to the direction of movement which the grain describes along a spiral path (24) after it leaves the guide element (21), viewed from a standpoint moving with the guide element (21). From the moving collision element (22), the grain is brought into a second straight path (25), after which it collides with the stationery collision element (26). Thus, here again if the position (27) where the grain is picked up by the guide element (21) is known, the position (27) where the grain leaves the guide element (21), the position (28) where the grain collides with the moving collision element (22) and the position (29) where the grain collides with the stationary collision element (26) are known (or predetermined), if the path (30) which the grain describes between the position (27) where the grain is picked up by the guide element (21) and the position (29) where the grain collides with the stationary collision element (26) is in a fixed location.

It is possible to allow the grain, after it has left the moving collision element (22), to collide at least once more with a subsequent moving collision element (not shown here) and then with the stationary collision element (26).

Figure 3:
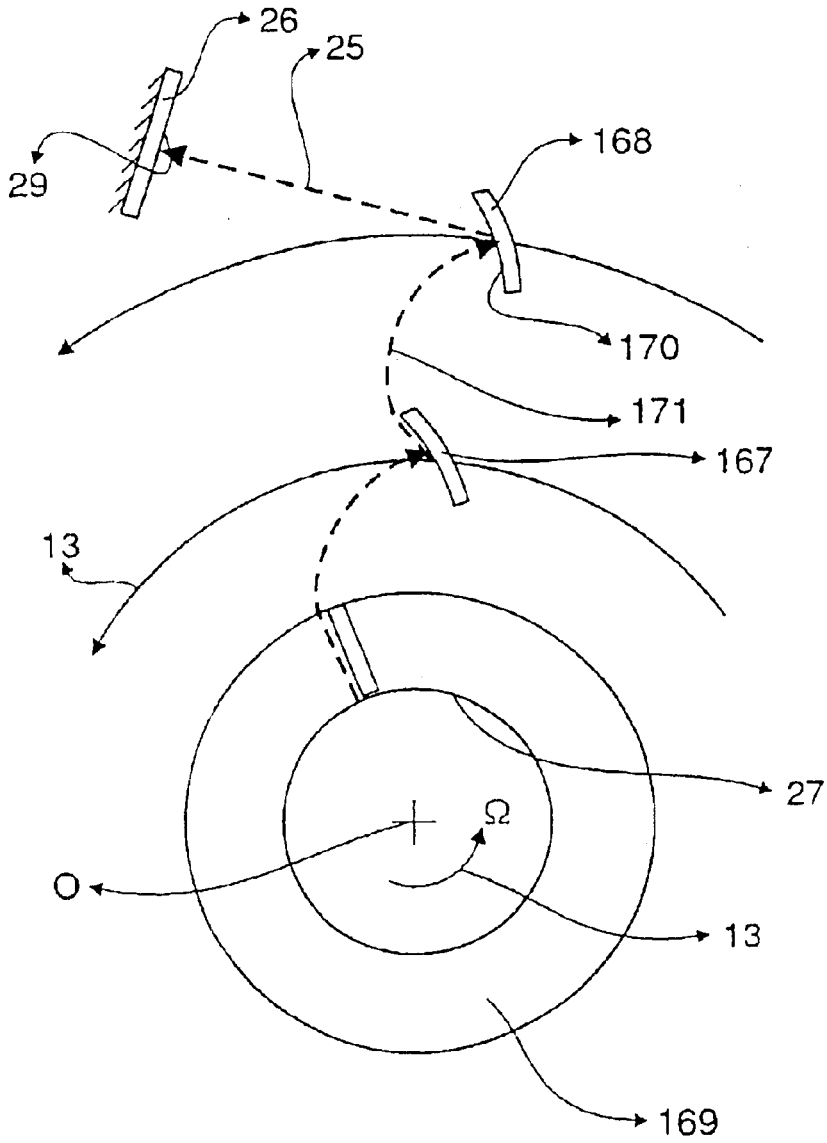
FIG. 3 shows, diagrammatically, the path which a grain describes on a rotor equipped with a guide element and two moving collision elements which are carried by the rotor and a stationary collision element.

FIG. 3 shows a situation similar to the situation in FIG. 2 where a subsequent moving collision element (168) is arranged at a location between the moving collision element (167) and the stationary collision element (26), which subsequent moving collision element (168) is carried by the rotor (169) and is provided with a subsequent collision surface (170) that is arranged transversely in the spiral path (171) that the material describes between the moving collision element (167) and the subsequent moving collision element (168), viewed from a standpoint moving with the subsequent moving collision element (168). What is achieved in this way is that the material impinges three times in succession. It is, of course, possible to install even more subsequent moving collision elements.

Figure 4:
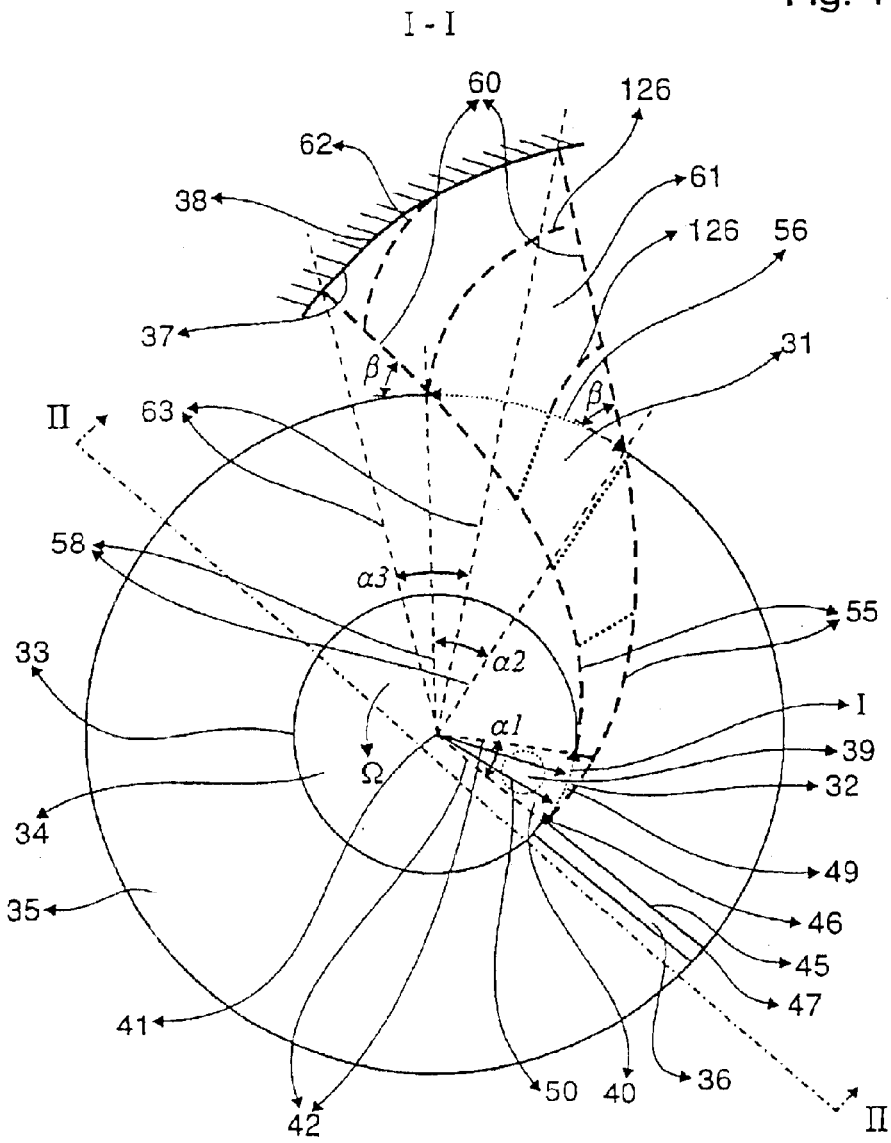
FIG. 4 shows, diagrammatically, a plan view I—I of a rotor with, thereon, the flow region which the grains describe on a rotor equipped with a guide element that is carried by the rotor and a stationary impact element.
Figure 5:
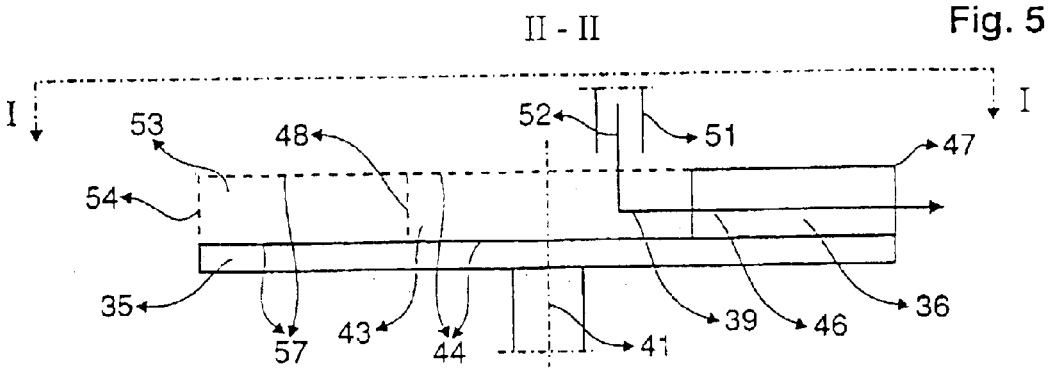
FIG. 5 shows, diagrammatically, a longitudinal section II—II from FIG. 4.

FIGS. 4 and 5 show a situation similar to the situation in FIG. 1, where it is not the movement of one grain along a path (9) that is described but the movement of a stream of grains in a flow region (31) which extends between the portion (32) of the edge (33) of the central chamber (34) of the rotor (35) where the material is picked up by the guide element (36) and the stationary collision surface (37) of the stationary collision element (38) which the material strikes when it is propelled outwards along the portion (32) of the edge of the rotor (35). This movement can be described in a number of steps, i.e.:

metering the material, with the aid of at least one stationary metering element (51) that is provided with at least one metering port (52) for metering the material into at least one metering region (39) which is at a position in a sector (40) of a central chamber (34) of the rotor (35), which central chamber (34) is in the form of a first imaginary revolving body (43), the axis of revolution of which is coincident with the axis of rotation (41), which sector (40) is in a first fixed location (I) and is defined by the space between the two parallel circles (44) which delimit the first imaginary revolving body (43) and between the two first radial planes (42) from the axis of rotation (41) which describe a first mid-point angle ($\alpha 1$), around which central chamber (34) at least one guide element (36) is arranged, which guide element (36) is carried by the rotor (35) and is provided with a guide surface (45) having a start edge (46) and an end edge (47), which guide surface (45) extends from the start edge (46) towards the outer edge (209) of the rotor (35), the first imaginary revolving surface (48) of the first imaginary revolving body (43) which is defined by the revolving start edge (46), viewed from a stationary standpoint;

distributing the metered material from the metering region (39) to at least one feed region (49), where the material is picked up by the guide element (36), for which distribution the material has to pass the start edge (46) of the guide element (36), which takes place by directing the material from the sector (40) in a virtually radial direction (50)—under influence of the rotation of the rotor—through an first imaginary window (210) which is in a second fixed location (II) in a position on the first imaginary revolving surface (48) which is determined by the portion of the first imaginary revolving surface (48) which describes the outside arc (211) of the sector (40);

feeding the distributed material, in the feed region (49), to the guide element (36), which feed region (49) is in a location close to the first imaginary window (210) a greater radial distance away from the axis of rotation (41) than is the start edge (46);

accelerating the fed material, from the start edge (46), along the guide surface (45) to the end edge (47) of the guide element (36), which revolving end edge (47) defines a second imaginary revolving surface (54) of a second imaginary revolving body (53), the axis of revolution of which is coincident with the axis of rotation (41), which acceleration takes place in a spiral portion (55), which is directed forwards, of the flow region (31), which is in a third fixed location (III) and extends from the first imaginary window (210) in the direction of a second imaginary window (56) which is in a fourth fixed location (IV), at a position in the second imaginary revolving surface (54), a greater distance away from the axis of rotation (41) than is the feed region (49), in front of the radial line from the axis of rotation (41) with, thereon, the position where the material is picked up by the guide element (36), between two planes (57) with, thereon, the position of the two parallel circles (44) which delimit the second imaginary revolving body (53) and between the two second radial planes (58) from the axis of rotation (41) which describe a second mid-point angle ($\alpha 2$) which is at least as large as the first mid-point angle ($\alpha 1$), viewed in the plane of rotation, viewed in the direction of rotation and viewed from a stationary standpoint;

releasing the accelerated material, at a position close to the second imaginary window (56), the grains leaving the guide element (36) at essentially the same first angle of flight ($\beta 1$) and being guided in straight paths (60), directed forwards and outwards, viewed from the axis of rotation (41), viewed in the plane of rotation, viewed in the direction of rotation and viewed from a stationary standpoint;

guiding the released material along the straight paths (60) through a straight second portion (61) of the flow region (31) which is formed by the bundle of the straight paths (60) and is in a fifth fixed location (V) and extends from the second imaginary window (56) in the direction of an collision region (62) which is in a sixth fixed location (VI) at a position in the straight second portion (61) of the flow region (31), a greater distance away from the axis of rotation (41) than is the position where the material leaves the guide element (36) and in front of the radial line from the axis of rotation (41) with, thereon, the position where the material leaves the guide element (36), viewed in the plane of rotation, viewed in the direction of rotation and viewed from a stationary standpoint;

causing the guided material to strike, in a position in the collision region (62), with the aid of the stationary collision element (38) that is provided with at least one stationary collision surface (37) and two outer edges (217) that are oriented essentially parallel to the axis of rotation (41) which stationary collision surface (37) is oriented essentially transversely to the direction of movement of the material in the straight second portion (61) of the flow region (31), which stationary collision surface (37) extends between two third radial planes (63) from the axis of rotation (41) which describe a third mid-point angle ($\alpha$3) which is at least as large as the second mid-point angle ($\alpha$2), viewed in the plane of rotation, viewed in the direction of rotation and viewed from a stationary standpoint.

Figure 6:
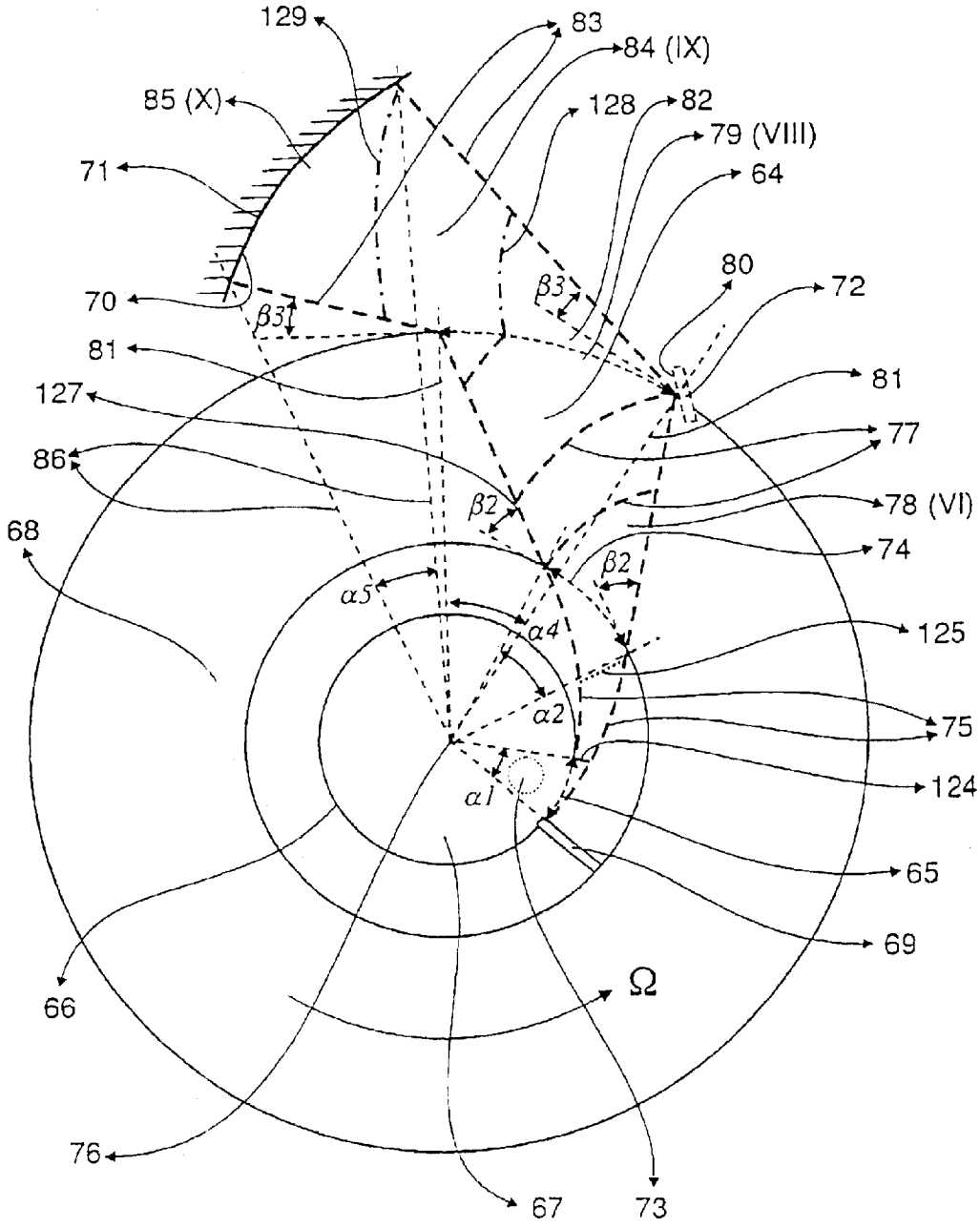
FIG. 6 shows, diagrammatically, the flow region which the grains describe on a rotor equipped with a guide element and a moving collision element which are carried by the rotor and a stationary collision element.

FIG. 6 shows a situation similar to the situation in FIG. 2, where it is not the movement of one grain along a path (30) (25) that is described but the movement of a stream of grains in a flow region (64) which extends between the portion (65) of the edge (66) of the central chamber (67) of the rotor (68) where the material is picked up by the guide element (69) and the stationary collision surface (70) of the stationary collision element (71) with which the material collides when it leaves a moving collision element (72) which is in a position between the guide element (69) and the stationary collision element (71). This movement can be described in a number of steps, the movement from the metering region (73) (39 in FIG. 4) up to and including acceleration along the guide element (69) (36 in FIG. 4) being completely identical to this part of the movement described for FIG. 4. Only the steps thereafter are described here, that is to say:

releasing the accelerated material for the first time at a position close to the second window (74), the grains of the material leaving the guide element (69) essentially at the same second angle of flight ($\beta$2) and being guided into first straight paths (75) oriented forwards and outwards, viewed from the axis of rotation (76), viewed in the plane of rotation, viewed in the direction of rotation and viewed from a stationary standpoint, and being guided into spiral paths (77) oriented backwards and outwards, viewed from the axis of rotation (76), viewed in the plane of rotation, viewed in the direction of rotation and viewed from a standpoint moving with the guide element (69);

guiding the material, released for the first time, for the first time along the first straight paths (75) through a first straight portion (78) of the flow region (64) that is formed by the bundle of the first straight paths (75) and is in a seventh fixed location (VII), viewed from the axis of rotation (76), viewed in the plane of rotation, viewed in the direction of rotation and viewed from a stationary standpoint, and along the spiral paths (77) through the flow region (64) that is formed by the bundle of the spiral paths (77) and is in a fixed location (not shown here), viewed in the plane of rotation, viewed in the direction of rotation and viewed from a standpoint moving with the guide element (69), which first straight portion (78) extend from the second window (74) in the direction of a first collision region (79) that is in an eighth fixed location (VIII) at a position in the first straight portion (78) of the flow region (64), a greater distance away from the axis of rotation (76) than is the position where the material leaves the guide element (69) and in front of the radial line from the axis of rotation (76) with, thereon, the position where the material leaves the guide element (69), viewed in the plane of rotation, viewed in the direction of rotation and viewed from a stationary standpoint;

causing the material, guided for the first time, to collide for the first time at a position in the first collision region (79), with the aid of the moving collision element (72) that is provided with at least one moving collision surface (80) that is oriented essentially transversely to the direction of the spiral movement of the material, viewed in the plane of rotation, viewed in the direction of rotation and viewed from a standpoint moving with the moving collision element (72), which first collision region (79) extends between two fourth radial planes (81) from the axis of rotation (76) which describe a fourth mid-point angle ($\alpha$4) which is at least as large as the second mid-point angle ($\alpha$2), viewed in the plane of rotation, viewed in the direction of rotation and viewed from a stationary standpoint;

releasing for the second time the material, that has collided once, at a position (82) close to the first collision region (79), the grains of the material leaving the moving collision element (72) essentially at the same third angle of flight ($\beta$3) and being guided into second straight paths (83) oriented forwards and outwards, viewed from the axis of rotation, viewed in the plane of rotation, viewed in the direction of rotation and viewed from a stationary standpoint;

guiding the material, that has been released for the second time, for the second time along the second straight paths (83) through a second straight portion (84) of the flow region (64) that is formed by the bundle of the second straight paths (83) and is in a ninth fixed location (IX) and extends from the first collision region (79) in the direction of a second collision region (85) that is in a tenth fixed location (X) at a position in the second straight portion (84) of the flow region (64), a greater distance away from the axis of rotation (76) than is the first collision region (79) and in front of the radial line from the axis of rotation (76) with, thereon, the position where the material that has collided once leaves the moving collision element (72), viewed in the plane of rotation, viewed in the direction of rotation and viewed from a stationary standpoint;

causing the material, that has been guided for the second time, to collide for the second time, at a position in the second collision region (85), with the aid of the stationary collision element (71) that is provided with at least one stationary collision surface (70) that is oriented essentially transversely to the direction of movement of the material in the second straight portion (84) of the flow region (64), which stationary collision surface (70) extends between two fifth radial planes (86) from the axis of rotation (76) which describe a fifth mid-point angle ($\alpha$5) which is at least as large as the fourth mid-point angle ($\alpha$4), viewed in the plane of rotation, viewed in the direction of rotation and viewed from a stationary standpoint.

The movements of the grains in the stream of material are also indicated in FIGS. 4, 5 and 6. In FIG. 6 The stream of material is fed in individual portions from the feed region (212) to the guide element (69), always at the point in time when the guide element (69) passes through (crosses) the feed region (212). Once it has been picked up by the guide element (69), the portion of material moves with the grains one after the other along the guide element (69) and forms, as it were, a section (124). As a result of the acceleration which takes place the grains are pulled apart (the distance between the grains increases towards the outside) and the material portion describes an increasingly longer section (125). The sections (124) (125) are in the shape of the guide surface but move as a whole, as it were laterally, through a spiral flow region (213). When the material leaves the guide element (69) the section assumes the shape of a spiral which moves as a whole, as it were laterally, through the first straight portion (78) of the flow region (64); however, the individual grains in the portion of material each move along a first straight path (75), as a result of which the distance between the grains viewed along the spiral paths (77) increases. The flow region (64) as a whole therefore widens, but the ends (127) of the portion of material still fall between two fourth radial planes (81) from the axis of rotation (76) which describe a section mid-point angle ($\alpha 2 \rightarrow \alpha 4$) which is approximately equal to the first mid-point angle ($\alpha 1$). During collision with the moving collision element (72) the spiral paths (77) as it were rolls off in contact with the moving collision surface (80). When the portion of material leaves the moving collision element (72) new spiral paths (126) (128) forms which moves laterally and in doing so lengthens (129) through the second straight portion (84) of the flow region (64) in the direction of the stationary collision element (71) and here again rolls off in contact with the stationary collision surface (70). What is achieved by constructing the stationary collision surface (70) in the shape of the roll-off circle of movement of the material, or as an evolvent (as shown here), is that all grains collide with the stationary collision surface (70) at the same angle.

In general, $\alpha 5 \geqq \alpha 4 \geqq \alpha 2 \geqq \alpha 1$, where $\alpha 1$ can be chosen to be between 30° and 180° and even more, with the aid of the metering region (39) (73). Because the grains can deviate somewhat from the path described during the free flight through the straight portions (61) (78) (84) of the flow region (31) (64), the third mid-point angle ($\alpha 3$), within which the stationary collision surface (37) extends, and, respectively, the fourth mid-point angle ($\alpha 4$), within which the stationary collision surface (70) extends, must usually be taken 10° to 20° larger than the first mid-point angle ($\alpha 1$) so that all grains are collected by the stationary collision surface (37) and the stationary collision surface (70) respectively.

The method of the invention thus makes it possible to allow the material to impinge completely without interference, or deterministically, both on the first collision surface and on the second collision surface. Intense and uniform stressing of the grains in the stream of material is thus achieved, which results in a high and uniform probability of break.

As is indicated in FIG. 3, the invention provides the facility for arranging between the moving collision element and the stationary collision element yet a further (second) moving collision element, along which the material from the (first) moving collision element is guided to the stationary collision element, the material thus colliding three times in direct succession.

In FIGS. 4, 5 and 6 the material is guided in one flow region (31) (64). It is, of course, possible to meter the material into several sectors, feeding of the material in multiple flow regions in the direction of the stationary impact or collision element associated with the particular flow region being achieved by this means.

Figure 7:
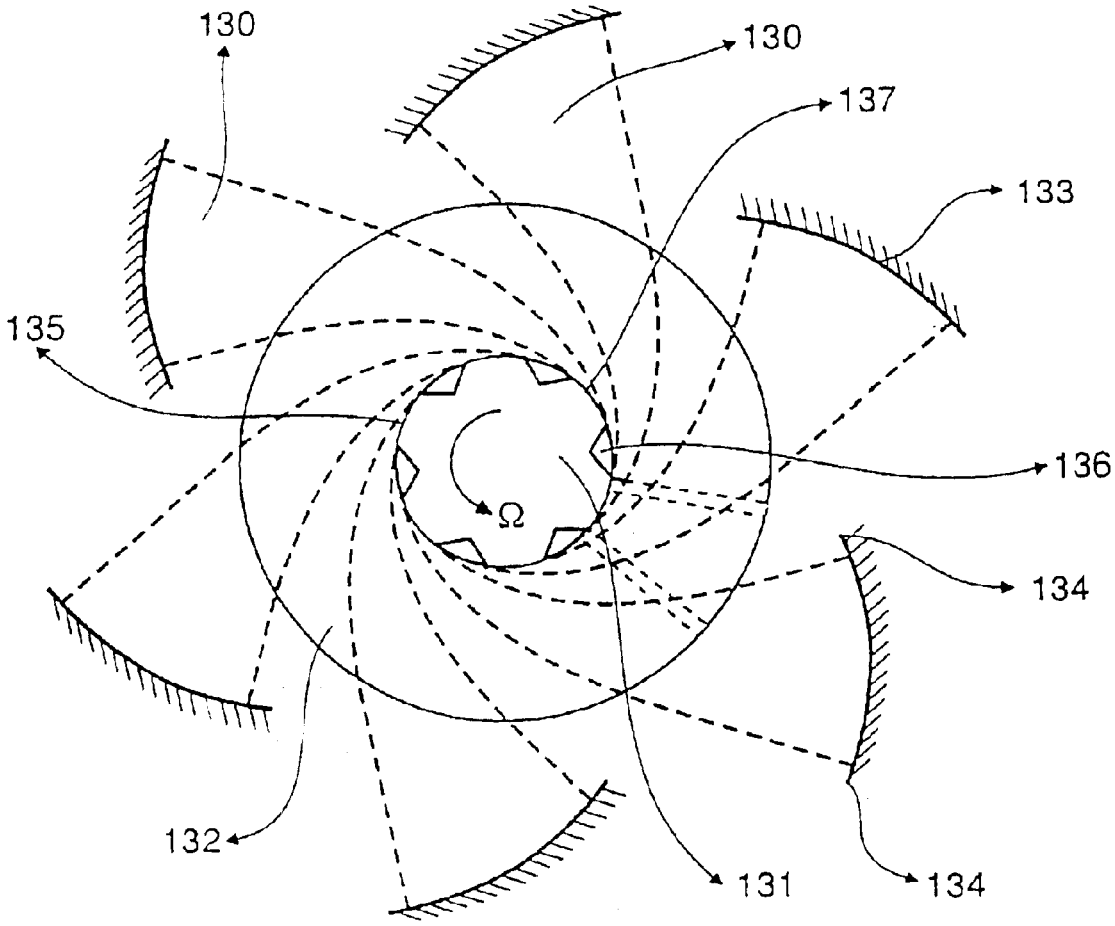
FIG. 7 shows, diagrammatically, a rotor essentially as in FIG. 1 equipped with deflector elements, as a result of which a number of flow regions are produced.

FIG. 7 shows how multiple pre-determined flow regions (130) of material can be directed from the central chamber (131) of the rotor (132) onto the stationary collision elements (133) in such a way that there is no contact with the edges (134) of the stationary collision elements (133). This is achieved by arranging a stationary distributor element, in the form of stationary deflector elements (136) placed regular distances apart, along the edge (135) of the central chamber (131). A number of distributor ports (137) are thus produced, which distributor ports (137) act as windows through which the material is directed outwards in a number of flow regions (130). The stationary deflector elements (136) interrupt the stream of material and thus make it possible, as it were, to mask the edges (134) of the stationary collision elements (133).

Figure 8:
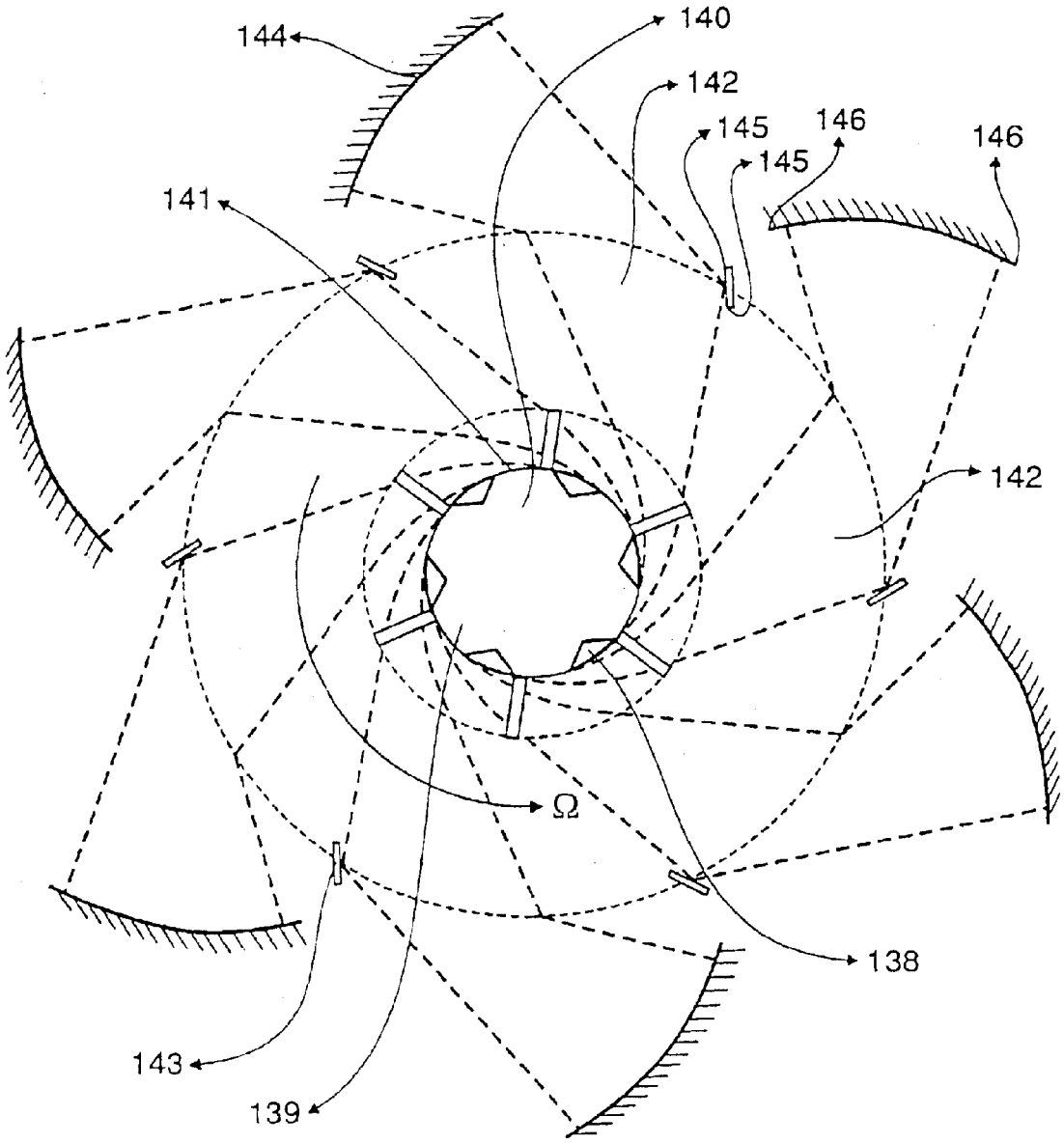
FIG. 8 shows, diagrammatically, a rotor essentially as in FIG. 2 equipped with deflector elements, as a result of which a number of flow regions are produced.

FIG. 8 shows a situation as in FIG. 7, stationary deflector elements (138) here again being arranged around the central chamber (139) of the rotor (140). Because the ports (141), and thus the windows, are fixed, the flow regions (142) through which the material is guided outwards are predetermined and both the collision with the moving collision element (143) and the collision with the stationary collision element (144) take place essentially free from interference, or essentially without contact with the respective edges (145) (146).

The method of the invention thus makes it possible to allow the material to impinge entirely free from interference, or deterministically, both on the impact surface and, successively, on the first collision surface and the second collision surface. Intense and uniform stressing of the grains in the stream of material is thus achieved, which results in a high and uniform probability of break.

Figure 9:
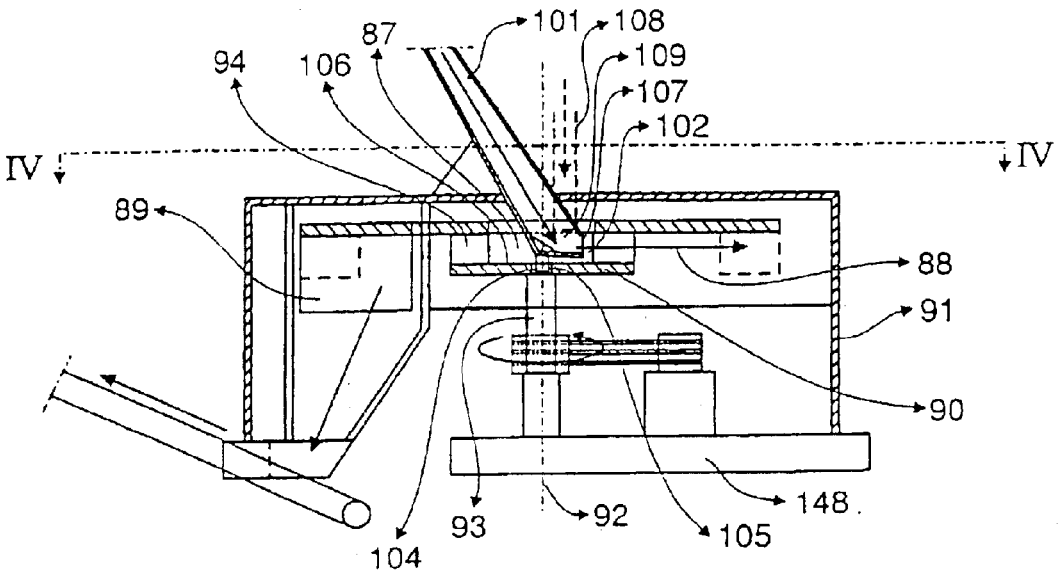
FIG. 9 shows, diagrammatically, a cross-section III—III of a first embodiment equipped with a rotor which rotates about a vertical axis of rotation, which rotor is equipped with guide elements and associated moving collision elements.
Figure 10:
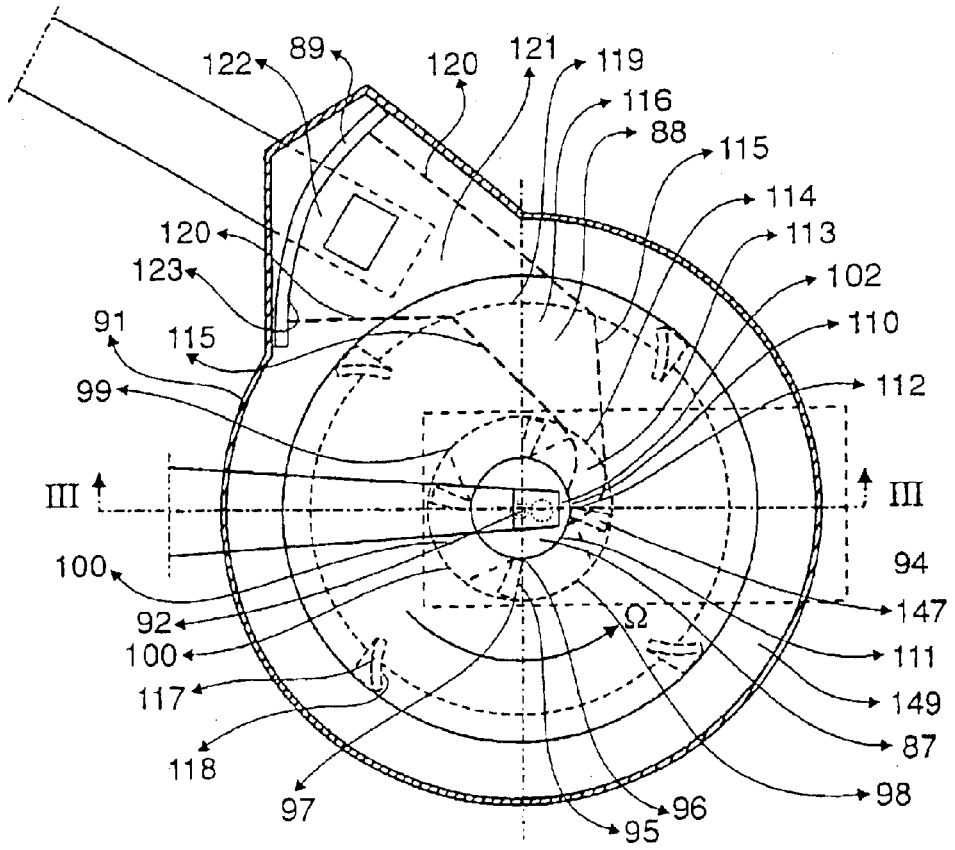
FIG. 10 shows, diagrammatically, a plan view IV—IV of FIG. 9.

FIGS. 9 and 10 show a first embodiment of the method of the invention described in FIG. 6 and partially in FIGS. 4 and 5, with which the material that is metered into the central chamber (87) and from there is guided in a flow region (88) that is in a predetermined, fixed location to a stationary collision element (89) that is arranged in a position outside the rotor (90). A rotor (90) that is rotatable about a vertical axis of rotation (92) and is supported on a shaft (93) is arranged in the breaker housing (91). The rotor (90) also carries a number of guide elements (94) which are arranged around a central chamber (87), which guide elements (94) are each provided with a guide surface (95) having a start edge (96) and an end edge (97), which guide surface (95) extends from the start edge (96) in the direction of the outer edge (98) of the rotor (90), which revolving start edge (96) defines the first imaginary revolving surface (99) (48) of a first imaginary revolving body (100) (43) which defines the central chamber (87). The material is metered with the aid of a stationary metering element (101) in the form of a pipe into a metering region (102) that is in a position in a sector (40) (FIGS. 4 and 5) in the central chamber (34) (67) (FIGS. 4 and 5) (87), which sector (40) is in a first fixed location (I), defined between the two first radial planes (42) (FIGS. 4 and 5) from the axis of rotation (41) (92) which describe a first mid-point angle ($\alpha 1$). The stationary metering element (101) can be additionally supported with the aid of a shaft (104) in an opening (105) in the central chamber (106) of the rotor (90) at the location of the axis of rotation (92). The shaft (104) is able to move freely in the opening (105) but can also be mounted on bearings. The stationary metering element (101) is provided with an outlet (metering port) (107) which functions as a metering port and is located in the sector (40). A vertical circular pipe (metering element) (108), the outlet (metering port) (109) of which is located in a position above the metering region (102) in the sector (40), is indicated by a broken line. The material is metered through the metering port (107) into the metering region (102) and from there is distributed in the radial direction to a feed region (110), from where the material is picked up by the guide element (94). It is of essential importance for the invention that this distribution takes place along a portion of the edge (111) of the central chamber (87), which portion can be described as a first imaginary window (112) in the first imaginary revolving surface (99) of the first imaginary revolving body (100), which first imaginary window (112) is in a second fixed location (II). The feed region (110) is therefore in a position close to the first imaginary window (112) a greater radial distance away from the axis of rotation (92) than is the start edge (96). When the material is picked up by the guide element (94) it is accelerated from the start edge (96) along the guide surface (95) and is then propelled outwards at the location of the end edge (97) of the guide element (94). This acceleration takes place in a spiral first portion (113), which is directed forwards, of the flow region (88), which is in a third fixed location (III) and extends from the first imaginary window (112) in the direction of a second imaginary window (114) which is in a fourth fixed location (IV), at a position in a second imaginary revolving surface (214) (54) that is defined by the second imaginary revolving body (215) (53) in which the end edge (97) revolves a greater distance away from the axis of rotation (92) than is the feed region (110), in front of the radial line from the axis of rotation (92) with, thereon, the position where the material is picked up by the guide element (94), between the two second radial planes (58) (FIG. 4) from the axis of rotation (41) (92) which describe a second mid-point angle ($\alpha 2$) which is at least as large as the first mid-point angle ($\alpha 1$), after which the accelerated grains leave the guide element (94) (36) at a position close to the second imaginary window (114) (74) essentially at the same second angle of flight ($\beta 2$) and are guided in straight paths (115) which are oriented forwards and outwards, through a first straight portion (116) of the flow region (88) that is formed by the bundle of the straight paths (115) and is in a seventh fixed location (VII), viewed from the axis of rotation (92), viewed in the plane of rotation, is viewed in the direction of rotation and viewed from a stationary standpoint, and along the spiral paths (77), viewed from the axis of rotation (92), viewed in the plane of rotation, viewed in the direction of rotation and viewed from a standpoint moving with the guide element (94). The first straight portion (116) of the flow region (88) extend from the second imaginary window (114) (74) in the direction of a first collision region which is in an eighth fixed location (VIII) at a position in the first straight portion (116) of the flow region (88) a greater distance away from the axis of rotation (92) than is the position where the material leaves the guide element (94) and in front of the radial line from the axis of rotation (92) with, thereon, the position where the material leaves the guide element (94), viewed in the plane of rotation, viewed in the direction of rotation and viewed from a stationary standpoint.

During each revolution a moving collision element (117) moves through the first collision region (119), which moving collision element (117) is carried by the rotor (90) and is provided with at least one moving collision surface (118) that is oriented essentially transversely to the direction of movement of the material in the second spiral portion (not shown in FIGS. 9 and 10) of the flow region (88), viewed in the plane of rotation, viewed in the direction of rotation and viewed from a standpoint moving with the moving collision element (117). The first collision region (119) extends between two fourth radial planes (81) from the axis of rotation (92) which describe a fourth mid-point angle ($\alpha 4$) which is at least as large as the second mid-point angle ($\alpha 2$), the material which has collided once being released for the second time by the moving collision element (117) in a position close to the first collision region (119), the grains of the material leaving the moving collision element (117) essentially at the same third angle of flight ($\beta 3$), after which the material released for the second time is guided for the second time along second straight paths (83) (120) through a second straight portion (121) of the flow region (88) that is formed by the bundle of the second straight paths (120) and is in a ninth fixed location (IX) and extends from the first collision region (119) in the direction of a second collision region (122) that is in a tenth fixed location (X) at a position in the second straight portion (121) of the flow region (88) a greater distance away from the axis of rotation (92) than is the first collision region (119) and in front of the radial line from the axis of rotation (92) with, thereon, the position where the material, that has collided once, leaves the moving collision element (117).

A stationary collision element (89) that is provided with a stationary collision surface (123) that is oriented essentially transversely to the direction of movement of the material, which has collided once, in the second straight portion (121) is arranged in the second collision region (122). The material then collides for the second time with the stationary collision surface (123) that extends between two fifth radial planes (86) from the axis of rotation (76) (92) which describe a fifth midpoint angle ($\alpha 5$) which is at least as large as the fourth midpoint angle ($\alpha 4$), viewed in the plane of rotation, viewed in the direction of rotation and viewed from a stationary standpoint.

In general $\alpha 5 \geqq \alpha 4 \geqq \alpha 2 \geqq \alpha 1$, where $\alpha 1$ can be chosen to be between 30° and 180° and even more with the aid of the metering region (39) (73) (102). Because the grains are able to deviate somewhat from the path described during free flight through the straight portions (61) (78) (84) of the flow region (31) (64) (88), the third mid-point angle ($\alpha 3$), within which the stationary collision surface (37) extends, and the fourth mid-point angle ($\alpha 4$), within which the stationary collision surface (70) (123) extends, usually has to be taken 10° to 20° larger than the first mid-point angle ($\alpha 1$) so that all grains are collected by the stationary collision surface (37) and the stationary collision surface (70) (123), respectively.

The shaft construction is supported (provided with foundations) on a support construction (148) which is accommodated in a support sector (147) below the rotor (90), which support construction (148) is essentially located in a sector (149), of a circular chamber (216) around the axis of rotation (92), which here describes a mid-point angle ($\gamma$) of approximately 90°.

The installation of the invention thus makes it possible to allow the material to impinge, completely free from interference, i.e. deterministically, both on the stationary collision surface (37), the moving collision surface (80) (118) and the stationary collision surface (70) (123). Intense and uniform stressing of the grains in the stream of material is achieved by this means, which results in a high and uniform probability of break.

Figure 11:
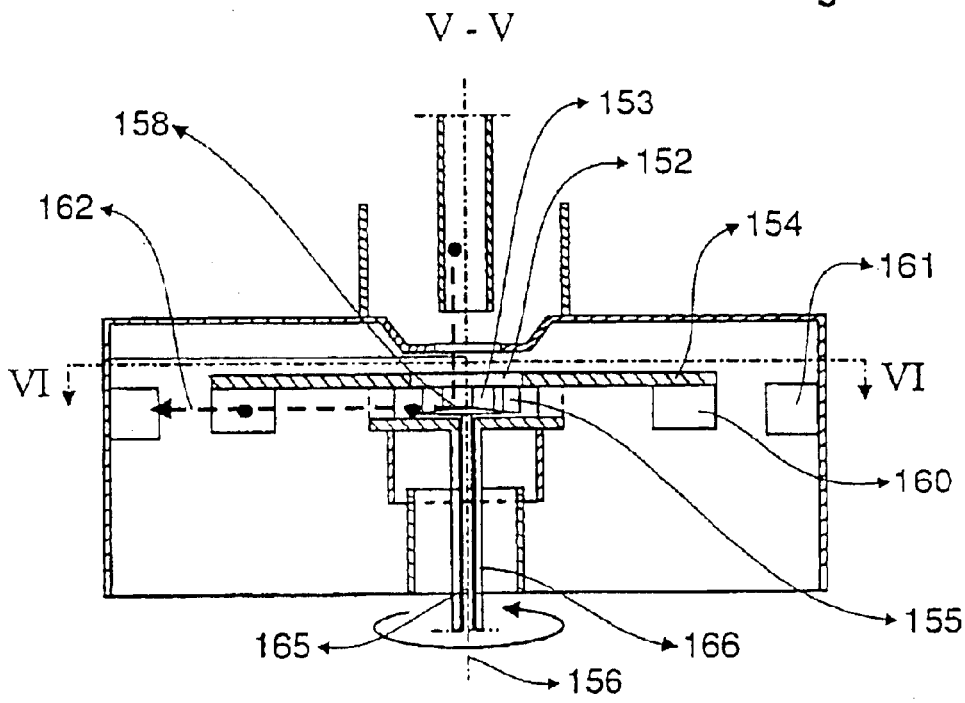
FIG. 11 shows, diagrammatically, a cross-section V—V of a second embodiment equipped with a rotor which rotates about a vertical axis of rotation, which rotor is equipped with deflector elements, guide elements and associated collision elements.
Figure 12:
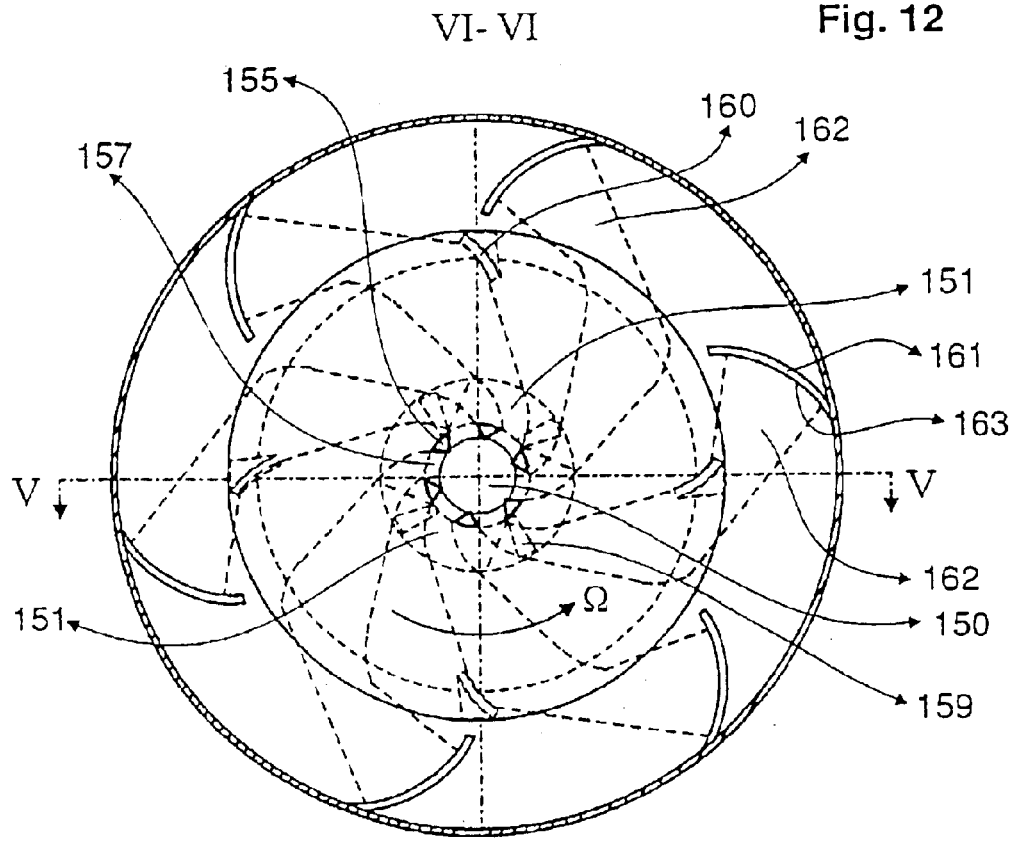
FIG. 12 shows, diagrammatically, a plan view VI—VI of FIG. 11.

FIGS. 11 and 12 show a second embodiment of an installation where the distribution of the material from the metering region (150) to the feed region (151) takes place with the aid of a stationary distributor element (152) that is arranged in the central chamber (153) of the rotor (154) and consists of a number of stationary deflector elements (155) in the form of triangular rods, one point of which is oriented in the direction of the axis of rotation (156). The stationary deflector elements (155) are arranged uniformly distributed around the central chamber (153) and the spaces between the stationary deflector elements (155) act as ports (157) (windows) through which the material is distributed from the central chamber (153) over the respective feed regions (151). The stationary deflector elements (155) are carried by a stationary mid section (158) which here is constructed in conical form and forms part of the stationary distributor element (152). The stationary deflector elements (155) are of triangular construction, but can also be constructed in the form of a circular rod or the like. The stream of material which is directed outwards via the port (157) is picked up in a feed region (151), that is defined on the rotor (154), by the guide element (159) that is passing through the feed region (151) at that point in time. The material is then accelerated along the guide element (159) and propelled outwards, in the direction of a moving collision element (160), from where the material is guided towards the stationary collision element (161). The material is thus guided in multiple flow regions (162) towards the stationary collision element (161), each of the flow regions (162) being in a (predetermined), fixed location.

The installation of the invention therefore makes it possible to arrange the stationary collision surfaces (163) of the stationary collision elements (161) in such a way that the material does not come into contact with the edges (164), so that the respective impacts take place essentially free from interference.

The stationary deflector elements (155) are carried by the stationary distributor element (152) which, in turn, is supported on a support shaft (165), which here is arranged centrically in the rotor shaft (166), which rotor shaft (166) is of hollow construction for this purpose. The invention provides the possibility of constructing the support shaft (165) such that it can be moved in the vertical direction, so that the material is directed at various heights from the metering surface to the guide element (159). The invention provides a possibility for bringing the stationary deflector elements (155) into vibration with the aid of the support shaft (165), so that the throughput of the material is improved. It is, of course, possible to support the stationary deflector element (155) at a position above the rotor (154), that is to say not by means of the rotor shaft (166).

Figure 13:
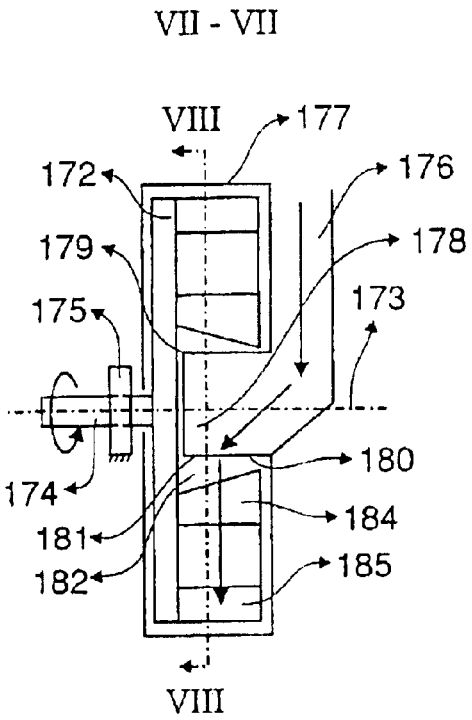
FIG. 13 shows, diagrammatically, a cross-section VII—VII of a third embodiment equipped with a rotor which rotates about a horizontal axis of rotation.
Figure 14:
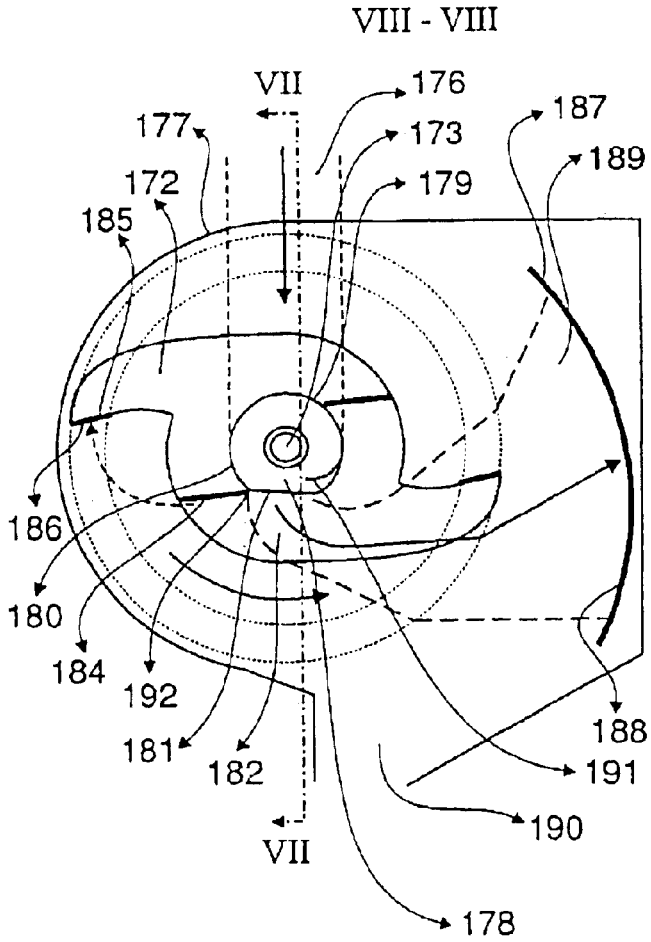
FIG. 14 shows, diagrammatically, a plan view VIII—VIII of FIG. 13.

FIGS. 13 and 14 show a third embodiment of a direct double impact breaker which is equipped with a rotor (172) which rotates about a horizontal axis of rotation (173). This embodiment is essentially based on the method described in FIG. 5. The rotor (172) is supported on a horizontal shaft (174) which is supported (175) immediately alongside the rotor (172) and is driven directly by means of a transmission or by means of V-belts.

The material is metered, by means of a metering element (176) in the form of a tube in the form of a funnel, from the top along the breaker housing (177) into the central chamber (178) of the rotor (172). Here the central chamber (178) is constructed as a stationary distributor element in the form of a cylindrical drum (179) which has an opening in the bottom of the cylinder wall (180), which opening acts as distributor port (181) through which the material is directed from the drum (179) to a feed region (182). The material is guided to the guide element (184), along which it is further guided towards the moving collision element (185), which is also carried by the rotor (172). The moving collision surface (186) of the moving collision element (185) is oriented essentially transversely to the spiral stream which the material describes between the guide element (184) and the moving collision element (185), viewed from a standpoint moving with the guide element (184). After the material has impinged on the moving collision surface (186) it is further guided in the direction of the stationary collision element (187), the stationary collision surface (188) of which is oriented essentially transversely to the direction of movement of the material between the moving (186) and the stationary (188) collision surface, viewed from a stationary standpoint. The material is guided as a whole into a flow region (189), the fixed location of which in the breaker housing (177) is determined by the position of the distributor port (181), which flow region (189) extends between the distributor port (181) and the stationary collision surface (188). After the material has collided with the stationary collision surface (188) it drops down and is collected in a funnel (190) and discharged.

It is preferable to arrange the front edge (191) of the distributor port (181) in the drum (179) (viewed in the direction of rotation) towards the inside (in the direction of the axis of rotation) (173), so that material is prevented from being able to become stuck between this front edge (191) and the start edge (192) of the guide element (184).

Here also it is possible to construct the rotor (172) with an subsequent moving collision element (168) as described in FIG. 3.

Figure 15:
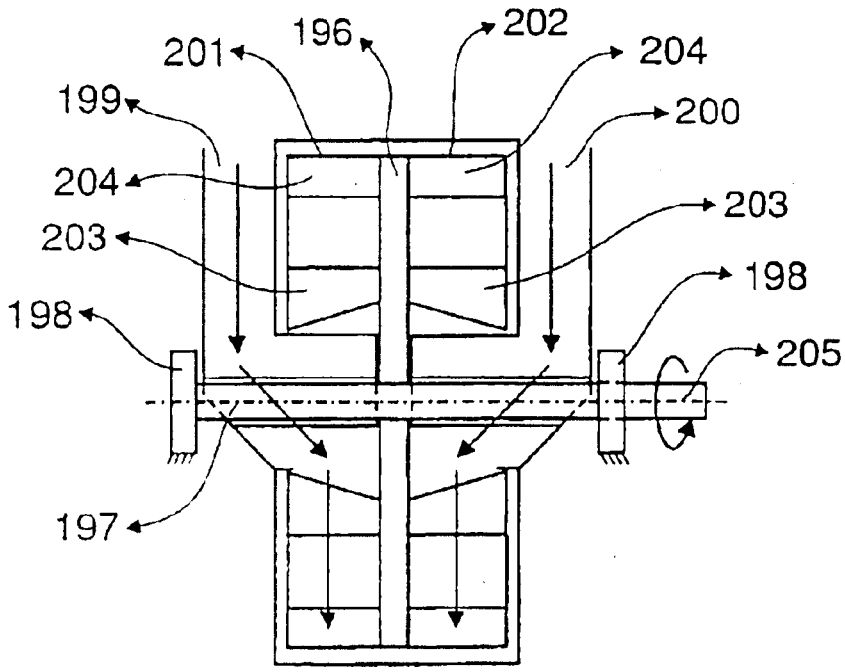
FIG. 15 shows, diagrammatically, a cross-section of a fourth embodiment equipped with a rotor which rotates about a horizontal axis of rotation, which rotor can be fed on two sides.

FIG. 15 shows a fourth embodiment where the rotor (196) is supported on a horizontal shaft (197) that is supported on both sides (198) of the rotor (196). This makes it possible to feed the breaker from both sides (199) (200) and to construct the rotor (196) identically on both sides (201) (202) with guide elements (203) and moving collision elements (204); however, it is, of course, also possible to make the two sides (201) (202) of different construction, for example with the moving collision element (204) at different distances from the horizontal axis of rotation (205) (but both with the first impact surface oriented transversely to the movement of material in the flow region), by which means different stressing of the material on the different sides is achieved. The side where the impact surface has been arranged closer to the horizontal axis of rotation (205) produces a coarser product than the other side. This makes it possible accurately to select or to control the gradation of the broken material. It is also possible to feed the breaker with different types of material on the two sides (201) (202), by which means a mixed broken product is produced, it also being possible to control the capacity on both sides (201) (202).

Figure 16:
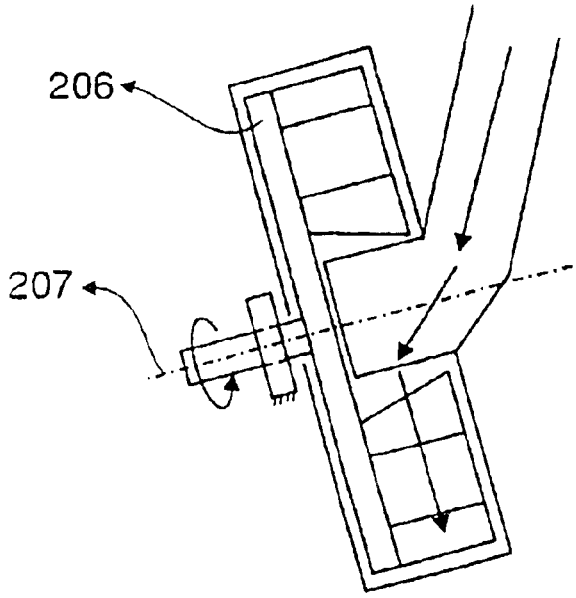
FIG. 16 shows, diagrammatically, a cross-section of a fifth embodiment equipped with a rotor which rotates about an oblique axis of rotation.

FIG. 16, finally, shows a fifth embodiment which in other respects is identical to the embodiment in FIG. 13 but is equipped with a rotor (206) which rotates about an axis of rotation (207) arranged at an angle, which, for example, can be advantageous for installation in a specific existing situation.

The above descriptions of specific embodiments of the present invention have been given with a view to illustration and descriptive purposes. They are not intended as an exhaustive list or to restrict the invention to the precise forms given and, in view of the above explanation, numerous modifications and variations are, of course, possible. The embodiments have been chosen and described in order to describe the principles of the invention and the possibilities for practical implementation thereof in the best possible way in order thus to enable others skilled in the art to make use in an optimum manner of the invention and the diverse embodiments with the various modifications suitable for the specific intended use. The intention is that the scope of the invention is defined by the appended claims in accordance with reading and interpretation in accordance with generally accepted legal principles, such as the principle of equivalents and the revision of parts.

What is claimed is:

1. Installation for accelerating granular material and causing the accelerated material to collide and break, comprising:

a shaft with an axis of rotation;

a rotor rotatably supported on said shaft and rotatable about said axis of rotation, said rotor having at least one side perpendicular to said axis of rotation, an outer edge of said side being essentially coincident with an outer edge of said rotor;

said rotor having a rotating central chamber area with an axis of revolution coincident with said axis of rotation;

said rotor having a revolving body area located concentric with said central chamber area and with an axis of revolution coincident with said axis of rotation;

a guide element carried on said side of said rotor and located within said revolving body area, said guide element having a guide surface with a revolving start edge and a revolving end edge, said guide surface extending from said revolving start edge towards said outer edge of said rotor, said revolving start edge defining a first revolving surface of said central chamber area, said revolving end edge defining a second revolving surface of said revolving body area;

a metering region located within a sector of said central chamber area, said sector being between two first radial planes originating from said axis of rotation and defining a first mid-point angle not greater than 180°, said sector terminating with an arc coincident with said first revolving surface, said arc defining a first window area within said first revolving surface;

a metering element with a metering port for metering granular material onto said side at said metering region;

a second window area coincident with said second revolving surface and between two second radial planes originating from said axis of rotation, said two second radial planes describing a second mid-point angle at least as large as said first mid-point angle;

a collision region outside said revolving body area and proximate said second window area;

a fixedly located material flow region for said granular material exiting said central chamber area and moving toward said collision region via said first and second windows areas said flow region adjoining said first window towards said collision region; and said flow region including a straight portion directed outwards and forwards when seen from a stationary viewpoint and a spiral portion directed outwards and backwards when seen from a viewpoint moving with said guide element a stationary collision element positioned in said collision region and presenting a stationary collision surface for said granular material to strike, said collision element having at least two outer edges oriented parallel to said axis of rotation and said collision surface oriented transversely to a direction of movement of said granular material in said straight portion of said flow region, said collision element extending between two third radial planes originating from said axis of rotation and describing a third mid-point angle at least as large as said second mid-point angle, said flow region having a width at said collision element that terminates interior to said outer edges of said collision element so that said granular material striking said collision element does not strike said outer edges.

2. Installation for accelerating granular material and causing the accelerated material to collide and break, comprising:

a shaft (93) with an axis of rotation (41, 76, 205);

a rotor (35, 68, 196) rotatably supported on said shaft and rotatable about said axis of rotation, said rotor having a side (201, 202) essentially perpendicular to said axis of rotation, an outer edge of said side being essentially coincident with an outer edge (209) of said rotor;

a central chamber area (34) of said rotor defining a first imaginary revolving body (43) with an axis of revolution coincident with said axis of rotation;

a second imaginary revolving body (53) of said rotor with an axis of revolution coincident with said axis of rotation, said second imaginary revolving body being outside of said first imaginary revolving body;

a guide element (36, 69, 203) carried on said side of said rotor and located outside of said central chamber area, said guide element having a guide surface (45) with a revolving start edge (46) and a revolving end edge (47), said guide surface extending from said revolving start edge towards said outer edge of said rotor, said revolving start edge defining a first imaginary revolving surface (48) of said first imaginary revolving body, said revolving end edge defining a second imaginary revolving surface (54) of said second imaginary revolving body;

a metering region (39) located within a sector (40) of said central chamber area, said sector being in a first fixed location (I) between two first radial planes (42) originating from said axis of rotation and defining a first mid-point angle ($\alpha$1) not greater than 180°, said sector terminating, at a second fixed location (II), with an arc coincident with said first imaginary revolving surface, said arc including a first imaginary window area (210) defining a feed region (49);

a metering element (51) with a metering port (52) for metering said granular material onto said side at said metering region;

a fixedly located flow region (31) for said granular material exiting said central chamber area, said flow region adjoining said first imaginary window area and located within said second imaginary revolving body, said flow region including, at a third (III) fixed location, a spiral portion (55) directed outwards and backwards, when seen from a viewpoint moving with said guide element and a straight portion at a fifth (V) location directed outwards and forwards when seen from a stationary viewpoint;

a second imaginary window area (56) at a fourth fixed location (IV) coincident with said second revolving surface and between two second radial planes (58) originating from said axis of rotation, said two second radial planes describing a second mid-point angle ($\alpha$2) at least as large as said first mid-point angle ($\alpha$1);

a stationary collision region (62, 79) at a fixed location outside said second imaginary revolving body and proximate said second imaginary window area, said second imaginary window area providing an exit for accelerated granular material leaving said guide element through said second imaginary window area and moving in a step along first paths (60) toward said fixed collision region, said first paths including i) straight paths directed outwards and forwards forming said straight flow region, as viewed from a direction of rotation and from a stationary viewpoint, and ii) spiral paths (77, 126) directed outwards and backwards forming said spiral flow region, as viewed from the direction of rotation and from a viewpoint moving with said guide element; and a stationary collision element (38) positioned in said stationary collision region at a fixed position in said straight portion (61, 84) of said flow region extending from said second imaginary window area to said stationary collision element, said stationary collision element presenting a stationary collision surface for said granular material to strike, said stationary collision element having at least two outer edges (217) oriented essentially parallel to said axis of rotation and said stationary collision surface (37) oriented transversely to a direction of movement of said granular material in said straight portion of said flow region, said stationary collision element extending between two third radial planes (63, 86) originating from said axis of rotation and describing a third midpoint angle ($\alpha 3$) at least as large as said second midpoint angle ($\alpha 2$), as viewed from said stationary collision element, said flow region having a width at said stationary collision element that terminates interior to said outer edges of said stationary collision element so that said granular material striking said stationary collision element does not strike said outer edges.

3. Installation according to claim 2, wherein the granular material is acceleratable in two steps, and further comprising:

a moving collision element (72) positioned within said flow region at a radial distance from said axis of rotation intermediate said second imaginary window area and said stationary collision element, said moving collision element presenting a first strike surface for said granular material to strike within a first moving collision region (79), said moving collision element being carried on said rotor and being provided with a moving collision surface (80), said moving collision element being located at a greater radial distance from said axis of rotation than said guide element, said moving collision surface, as seen from said moving collision surface, being oriented essentially transversely to the direction of movement of the granular material in said spiral portion (78) of said flow region when said moving collision surface moves during each revolution of said rotor through said moving collision region, the striking of the granular material on said moving collision surface causing grains of the granular material to be accelerated and released from said moving collision element into a direction of said stationary collision region, said stationary collision region being located at a greater radial distance from said axis of rotation than said moving collision region.

4. Installation according to claim 2, wherein said metering element (101) is formed by a body in funnel form with an outlet (107) serving the a metering port, said outlet being directed onto said metering region.

5. Installation according to claim 2, further comprising a stationary distributor element (152) arranged around said central chamber area and provided with a distributor port (157) for distributing the granular material from said metering region through said first imaginary window area into said feed region.

6. Installation according to claim 5, wherein, said stationary distributor element is formed by at least three deflector elements (136, 138, 155) arranged at uniform distances apart along an edge (135) of said central chamber area, and spaces (137) between said deflector elements each serve as a distributor port, said deflector distributor elements are formed by an essentially vertical rod construction.

7. Installation according to claim 5, wherein, said stationary distributor element is formed by a drum (179), an outside of said drum is the shape of a revolving body, and an opening (181) in said drum serves as the distributor port.

8. Installation according to claim 7, said drum has a cylindrical shape.

9. Installation according to claim 2, wherein said rotor does not rotate about a vertical axis of rotation.

10. Installation according to claim 2, wherein said metering element is formed by a sloping channel construction.

11. Installation according to claim 2, wherein said rotor is supported by said shaft on only one side of said rotor.

12. Installation according to claim 2, wherein said rotor is supported by said shaft on both sides of said rotor.

13. Installation according to claim 2, wherein said rotor does rotate about a horizontal axis of rotation.

14. Installation according to claim 2, wherein said rotor is provided with two sides (201, 202).

15. Installation according to claim 14, wherein said rotor is provided with guide elements (203) and moving collision elements (204) on both sides of said rotor, making it possible to feed said rotor with the granular material from both sides.

16. Installation according to claim 15, wherein at one side (201) of said rotor said moving collision elements are positioned at different distances from said axis of rotation than on the other side (202) of said rotor.

17. Installation according to claim 15, wherein one side (201) of said rotor (196) may be fed with a different type of material than the other side (202) of said rotor.

18. Installation according to claim 15, wherein there is a metering element for each side of said rotor, a first metering element for one side (201) of said rotor having a feed capacity different from a feed capacity of a second metering element for the other side (202) of said rotor.

19. Installation according to claim 2, wherein said shaft is rotatable around a vertical axis of rotation, and can be moved in vertical direction.

20. Installation according to claim 2, wherein said shaft is provided with a direct drive.

21. Installation according to claim 2, wherein, said shaft is supported on a support construction (148) located in a support sector (147) below said rotor, and said support construction is essentially located in a sector (149), of a circular chamber (216) around said axis of rotation, describing a mid-point angle (γ) not smaller than 30° and not greater than 180°.

22. Installation according to claim 2, wherein said third mid-point angle is 10° to 20° larger than said first mid-point angle.

23. Installation according to claim 2, wherein said stationary collision surface is in the shape of the roll-off circle of the movement of the granular material so that all grains of the granular material collide with said collision surface at the same angle.

24. Method for accelerating a stream of grains of granular material in a step and striking the grains of said granular stream of material at least once, with the aid of a rotor (35) (68) (196) that rotates about an axis of rotation (41) (76) (205) in a direction and is provided with a side (201) (202) that is directed essentially perpendicular to said axis of rotation (41) (76) (205), the outer edge of which side is essentially coincident with the outer edge (209) of said rotor (35) (68) (196), comprising the steps of metering said material onto a side (201) of said rotor (35) (68) (196) with the aid of a metering element into a metering region at a location near said axis of rotation (41) (76) (205), accelerating said metered material in at least a first step with the aid of a guide element (36) (69) (203) that is carried by said rotor (35) (68) (196) on said side and is located a greater radial distance away from said axis of rotation (41) (76) (205) than said metering region and is provided with a start edge (46) for feeding said metered material to said guide element (36) (69) (203), a guide surface (45) that extends into the direction of the outer edge (209) of said rotor (35) (68) (196) for accelerating said material by sliding along said guide surface (45) with the aid of centrifugal force and an end edge (47) where said accelerated material is released from said guide element (36) (69) (203), moving each of the grains of said accelerated material from said end edge (47) along a path (60) (75) through a flow region that is formed by the bundle of said paths (60) (75) towards a collision element (38) (71) (72) for striking said material at least once, which collision element (38) (71) (72) is located at a greater radial distance away from said axis of rotation (41) (76) (205) than said guide element (36) (69) (203) and is provided with a collision surface (37) (70) (80) that is directed essentially transversely to the movement of said material in said flow region, seen from said collision element (38) (71) (72), that is at least a stationary collision element (38) (71) that is provided with a stationary collision surface (37) (70) and at least two outer edges (217) that are oriented essentially parallel to said axis of rotation (41) (76) (205), for comminution of said material;

characterized in that:

said feeding, said acceleration, said moving and said striking of said stream of granular material takes place in a separate flow region (31) (64) (130) (142) that is in a predetermined fixed location between two radial planes from said axis of rotation (41) (76) (205) such that said separate flow region (31) (64) (130) (142) is at least a distance away from any other separate flow region (130) (142), which flow region (31) (64) (130) (142) extends between a metering region (39) (73) where said stream of granular material is metered onto said rotor (35) (68) (196), a feed region (49) (212) where said metered material is fed to said guide element (36) (69) for acceleration and a collision region (62) (79) (85) where the accelerated material strikes said collision surface (37) (70) (80), which metering region (39) (73), feed region (49) (212) and collision regions (62) (79) (85) are also in a fixed location, all seen from a stationary viewpoint, comprising the following steps:

metering said material on a side (201) (202) of said rotor (35) (68) (196), with the aid of a stationary metering element (51) that is provided with a metering port (52) for metering said material into a metering region (39) (73) which is at a position in a sector (40) of a central chamber (34) of said rotor (35) (68) (196), which central chamber (34) is in the form of a first imaginary revolving body (43) of which the revolving start edge (46) of said guide element (36) (69) (203) defines the first imaginary revolving surface (48), the axis of revolution of which is coincident with said axis of rotation (41) (76) (205), which sector (40) is in a first fixed location (I) between two first radial planes (42) from said axis of rotation (41) (76) (205) which describe a first mid-point angle (α1) which is not greater than 180°, around which central chamber (34) said guide element (36) (69) (203) is arranged, all viewed from a stationary standpoint;

the metered material is then distributed with at least the aid of said metering element (51) from said metering region (39) (73) to a feed region (49) (212), where said metered material is picked up by said guide element (36) (69) (203), for which distribution said metered material has to pass said first imaginary revolving surface (48), which takes place by directing said metered material with at least the aid of said stationary metering element (51) from said sector (40) in a virtually radial direction through a separate first imaginary window (210) which is in a second fixed location (II) at a position in said first imaginary revolving surface (48) which is essentially determined by the portion of said first imaginary revolving surface (48) which describes the outside arc (211) of said sector (40), which first imaginary window (210) actually determines said fixed location of said flow region (31) (64) (130) (142), viewed from a stationary standpoint;

the distributed material is then fed, in said feed region (49) (212), to said guide element (36) (69) (203);

the fed material is then accelerated along said guide surface (45), of which the revolving end edge (47) defines a second imaginary revolving surface (54) of a second imaginary revolving body (53), the axis of revolution of which is coincident with said axis of rotation (41) (76) (205), which acceleration takes place in a spiral portion (55) of said flow region (31) (64), which is directed outwards and forwards and is in a third fixed location (III) and extends from said first imaginary window (210) in the direction of a second imaginary window (56) which is in a fourth fixed location (IV), at a position in said second imaginary revolving surface (54), between two second radial planes (58) from said axis of rotation (41) (76) (205) which describe a second midpoint angle (α2) which is at least as large as said first mid-point angle (α1), viewed in the direction of rotation and viewed from a stationary standpoint;

the accelerated material is then released, the grains of said accelerated material leaving said guide element (36) (69) (203) through said second imaginary window (56);

each released grain then moves in a step along at least a first path (60) (75) through at least a first straight portion (61) (78) of said flow region (31) (64), which first paths appear first straight paths (60) (75) and are directed outwards and forwards, seen into the direction of rotation and seen from a stationary viewpoint and appear first spiral paths (77) (126) and are directed outwards and backwards, seen into the direction of rotation and seen from a viewpoint moving with said rotor (35) (68) (196), which first straight portion (61) (78) of said flow region (31) (64) is formed by the bundle of said first straight paths (60) (75) and is in a fixed location (V) (VII) and extends from said second imaginary window (56) in the direction of at least a first collision region (62) (79), which is in a fixed location (VI) (VII) at a position in said first straight portion (61) (78) of said flow region (31) (64), and extends between two radial planes (63) (81) from said axis of rotation (41) (76) that describe a midpoint angle (α3) (α4) that is as least as large as said second midpoint angle (α2) viewed in the direction of rotation and viewed from a stationary standpoint;

causing the moving material to strike at least once, in a position in said first collision region (62) (79), with the aid of a collision element (38) (72), that is provided with a collision surface (37) (80) which is oriented essentially transversely to the direction of movement of said material in said first straight portion (61) (78) of said flow region (31) (64), viewed from said collision element;

where:

said stream of material strikes at least a collision element (38) (71) that is in a stationary position and is provided with at least two outer edges (217) that are oriented essentially parallel to said axis of rotation (41) (76) (205) and a stationary collision surface (37) (70), which stationary collision element (38) (71) is in a position in a collision region (62) (85) that is in a fixed location (VI) (X) at a position in a straight portion (61) (84) of said flow region (31) (64), which stationary collision surface (37) (70) is oriented essentially transversely to the direction of the movement of said material in said straight portion (61) (84) of said flow region (31) (64) and extends between two radial planes (63) (86) from said axis of rotation (41) (76) (205) which describe a midpoint angle (α3) (α5) that is as least as large as said second midpoint angle (α2), seen from a stationary viewpoint, such that said stream of granular material does not strike said outer edges (217) of said stationary collision element (38) (71).

25. Method according to claim 24, for accelerating a stream of material in two steps and striking the grains of said stream of material two times in immediate succession, comprising the following steps:

causing said moving material to strike for a first time, in a position within said first collision region (79) that is in an eight fixed location (VIII) and extends between two fourth radial planes (81) from said axis of rotation (76) which describes a fourth midpoint angle (α4) which is as least as large as said second midpoint angle (α2), seen from a stationary viewpoint, with the aid of a moving collision element (72) that is carried by said rotor (68) on said side (201) (202) at a location a greater distance away from said axis of rotation (76) than said guide element (69) and is provided with a moving collision surface (80) that is oriented essentially transversely to the bundle of said first spiral paths (77) when said moving collision surface (80) moves during each revolution of said rotor (68) through said first collision region (79), seen from said moving collision element (72), during which first strike the grains are simultaneously loaded and further accelerated;

the further accelerated material is then released, the grains leaving said first collision element (72);

each released grain then moves further along a second straight path (83) through a second straight portion (84) of said flow region (64), which is directed outwards and forwards, and which is formed by the bundle of said second straight paths (83) and is in a ninth fixed location (IX) and extends from said first collision region (79) into the direction of a second collision region (85) which is in a tenth fixed location (X) at a position in said second straight portion (84) of said flow region (64), seen from a stationary viewpoint;

causing said further moving material to strike for a second time with the aid of a stationary collision element (71) that is in a position in said second collision region (85) which is in a tenth fixed location (X) and is provided with at least two outer edges (217) that are oriented essentially parallel to said axis of rotation (76) a stationary collision surface (70) that is oriented essentially transversely to the movement of said material in said second straight portion (84) of said flow region (64), seen from said stationary collision element (71) and extends between two fifth radial planes (86) from said axis of rotation (76) which describe a fifth midpoint angle (α5) which is as least as large as said second midpoint angle (α2), seen from said stationary viewpoint, such that said stream of granular material does not strike said outer edges (217) of said stationary collision element (71).

* * * * *

UNITED STATES PATENT AND TRADEMARK OFFICE

CERTIFICATE OF CORRECTION

PATENT NO. : 6,786,436 B1 
DATED : September 7, 2004
INVENTOR(S) : Johannes Petrus Andreas Josephus Van Der Zanden It is certified that error appears in the above-identified patent and that said Letters Patent is hereby corrected as shown below:

Title page,
Insert Item:
-- [30] Foreign Application Priority Data

May 11, 1999 (NL) ……..1012022 --.

Signed and Sealed this

Fourteenth Day of December, 2004

JON W. DUDAS
*Director of the United States Patent and Trademark Office*